US008457975B2

(12) United States Patent
Neuendorf et al.

(10) Patent No.: US 8,457,975 B2
(45) Date of Patent: Jun. 4, 2013

(54) AUDIO DECODER, AUDIO ENCODER, METHODS FOR DECODING AND ENCODING AN AUDIO SIGNAL AND COMPUTER PROGRAM

(75) Inventors: Max Neuendorf, Nuremberg (DE); Jeremie Lecomte, Nuremberg (DE); Markus Multrus, Nuremberg (DE); Stefan Bayer, Nuremberg (DE); Frederik Nagel, Nuremberg (DE); Guillaume Fuchs, Nuremberg (DE); Julien Robilliard, Nuremberg (DE); Nikolaus Rettelbach, Nuremberg (DE); Ralf Geiger, Nuremberg (DE); Bernhard Grill, Lauf (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 799 days.

(21) Appl. No.: 12/694,912

(22) Filed: Jan. 27, 2010

(65) Prior Publication Data

US 2010/0217607 A1 Aug. 26, 2010

Related U.S. Application Data

(60) Provisional application No. 61/147,895, filed on Jan. 28, 2009.

(51) Int. Cl.
*G10L 21/00* (2006.01)

(52) U.S. Cl.
USPC ..... 704/500; 704/219; 375/240

(58) Field of Classification Search
USPC ..... 704/219, 500; 375/240
See application file for complete search history.

(56) References Cited

U.S. PATENT DOCUMENTS 5,297,236 A * 3/1994 Antill et al. ..... 704/203
5,299,238 A * 3/1994 Iwahashi et al. ..... 375/240
(Continued)

FOREIGN PATENT DOCUMENTS

WO WO2008/071353 A2 6/2008
WO WO2010/003532 2/2010
(Continued)

OTHER PUBLICATIONS

ISO/IEC 14496-3:2005(E); "Information Technology-Coding of Audio-Visual Objects"; Dec. 2005, copyright 2005; prepared by Joint Technical Committee ISO/IEC JTC 1, Information Technology,Subcommittee SC 29, Coding of Audio, Picture, Multimedia and Hypermedia Information; "Introduction", pp. ii-xiv.
(Continued)

*Primary Examiner* — Daniel D Abebe
(74) *Attorney, Agent, or Firm* — Michael A. Glenn; Glenn Patent Group

(57) ABSTRACT

An audio decoder for providing a decoded representation of an audio content on the basis of an encoded representation of the audio content comprises a linear-prediction-domain decoder core configured to provide a time-domain representation of an audio frame on the basis of a set of linear-prediction domain parameters associated with the audio frame and a frequency-domain decoder core configured to provide a time-domain representation of an audio frame on the basis of a set of frequency-domain parameters, taking into account a transform window out of a set comprising a plurality of different transform windows. The audio decoder comprises a signal combiner configured to overlap-and-add-time-domain representations of subsequent audio frames encoded in different domains, in order to smoothen a transition between the time-domain representations of the subsequent frames. The set of transform windows comprises one or more windows specifically adapted for a transition between a frequency-domain core mode and a linear-prediction-domain core mode.

35 Claims, 15 Drawing Sheets

U.S. PATENT DOCUMENTS

| | | | | |
|---|---|---|---|---|
| 5,606,642 | A * | 2/1997 | Stautner et al. | 704/205 |
| 5,848,391 | A * | 12/1998 | Bosi et al. | 704/200.1 |
| 2012/0022881 | A1* | 1/2012 | Geiger et al. | 704/504 |
| 2012/0245947 | A1* | 9/2012 | Neuendorf et al. | 704/500 |

FOREIGN PATENT DOCUMENTS

| | | |
|---|---|---|
| WO | WO2010/003563 | 2/2010 |
| WO | WO-2010/148516 | 12/2010 |
| WO | WO-2011/085483 | 7/2011 |

OTHER PUBLICATIONS

ISO/IEC 14496-3:2005(E); "Information Technology-Coding of Audio-Visual Objects"; Dec. 2005, copyright 2005; prepared by Joint Technical Committee ISO/IEC JTC 1, Information Technology,Subcommittee SC 29, Coding of Audio, Picture, Multimedia and Hypermedia Information; "Subpart 1" pp. 1-120.

ISO/IEC 14496-3:2005(E); "Information Technology-Coding of Audio-Visual Objects"; Dec. 2005, copyright 2005; prepared by Joint Technical Committee ISO/IEC JTC 1, Information Technology,Subcommittee SC 29, Coding of Audio, Picture, Multimedia and Hypermedia Information; "Subpart 4", pp. 1-344.

Neundorf, et al.; "Unified Speech and Audio Coding Scheme for High Quality at Low Bitrates"; Apr. 19, 2009; IEEE Int'l Conf. on Acoustics, Speech and Signal Processing, ICASSP 2009, pp. 1-4, XP031459151, Piscataway, NJ.

Extended European Search Report dated Dec. 29, 2010 in related European Patent Application 10152001.3, 13 pages.

* cited by examiner

| FIG 1 | |
|---|---|
| FIG 1A | FIG 1B |

| FIG 1 | |
|---|---|
| FIG 1A | FIG 1B |

| FIG 2 | |
|---|---|
| FIG 2A | FIG 2B |

| FIG 2 | |
|---|---|
| FIG 2A | FIG 2B |

-Window Sequences and Transform windows

Legend:

| Value | Window | #coeffs |
|---|---|---|
| 0 | ONLY_LONG_SEQUENCE =LONG_WINDOW | 1024/960 |
| 1 | LONG_START_SEQUENCE =LONG_START_WINDOW | 1024/960 |
| 2 | EIGHT_SHORT_SEQUENCE =8*_SHORT_WINDOW | 8*(128/120) |
| 3 | LONG_STOP_SEQUENCE =LONG_STOP_WINDOW | 1024/960 |
| 1 | STOP_START_SEQUENCE =STOP_START_WINDOW | 1024/960 |
| 3 | STOP_1152_SEQUENCE =STOP_WINDOW_1152 | 1152/1080 |
| 1 | STOP_START_1152_SEQUENCE =STOP_START_WINDOW_1152 | 1152/1080 |

| FIG 3 | |
|---|---|
| FIG 3A | FIG 3B |

| FIG 3 | |
|---|---|
| FIG 3A | FIG 3B |

allowed window sequences

| window sequence<br>to →<br>from ↓ | ONLY_LONG_SEQUENCE | LONG_START_SEQUENCE | EIGHT_SHORT_SEQUENCE | LONG_STOP_SEQUENCE | STOP_START_SEQUENCE | LPD_SEQUENCE | STOP_1152_SEQUENCE | STOP_START_1152_SEQUENCE |
|---|---|---|---|---|---|---|---|---|
| ONLY_LONG_SEQUENCE | ☑ | ☑ | | | | | | |
| LONG_START_SEQUENCE | | | ☑ | ☑ | ☑ | ☑ | | |
| EIGHT_SHORT_SEQUENCE | | | ☑ | ☑ | ☑ | ☑ | | |
| LONG_STOP_SEQUENCE | ☑ | ☑ | | | | | | |
| STOP_START_SEQUENCE | | | ☑ | ☑ | ☑ | ☑ | | |
| LPD_SEQUENCE | | | | | | ☑ | ☑ | ☑ |
| STOP_1152_SEQUENCE | ☑ | ☑ | | | | | | |
| STOP_START_1152_SEQUENCE | | | ☑ | ☑ | ☑ | ☑ | | |

FIG 5

AUDIO DECODER, AUDIO ENCODER, METHODS FOR DECODING AND ENCODING AN AUDIO SIGNAL AND COMPUTER PROGRAM

CROSS REFERENCE TO RELATED APPLICATIONS

This patent application claims the benefit of U.S. provisional patent application Ser. No. 61/147,895 filed Jan. 28, 2009, the entirety of which is incorporated herein by this reference thereto.

BACKGROUND OF THE INVENTION

Embodiments according to the invention are related to an audio decoder for providing a decoded audio information on the basis of an encoded audio information and to an audio encoder for providing an encoded audio information on the basis of an input audio information. Further embodiments are related to a method for providing a decoded representation of an audio content on the basis of an encoded representation of the audio content and to a method for providing an encoded representation of an audio content on the basis of an input representation of the audio content. Yet further embodiments according to the invention are related to computer programs for performing the inventive methods.

Embodiments according to the invention are related to improvements of a transition from a frequency-domain mode to a linear-prediction-domain mode.

In the following, some background information of the invention will be explained in order to facilitate the understanding of the invention and the advantages thereof. During the past decade, big efforts have been put on creating the possibility to digitally store and distribute audio contents. One important achievement on this way is the definition of the International Standard ISO/IEC 14496-3. Part 3 of this Standard is related to an encoding and decoding of audio contents, and subpart 4 of part 3 is related to general audio coding. ISO/IEC 14496 part 3, subpart 4 defines a concept for encoding and decoding of general audio contents. In addition, further improvements have been proposed in order to improve the quality and/or reduce the required bitrate.

According to the concept described in said standard, a time-domain audio signal is converted into a time-frequency representation. The transform from the time-domain to the time-frequency-domain is typically performed using transform blocks, which are also designated as "audio frames" or briefly "frames".

It has been found that it is advantageous to use overlapping frames, which are shifted, for example, by half a frame, because the overlap allows to efficiently avoid artifacts. In addition, it has been found that a windowing should be performed in order to avoid the artifacts originating from the processing of temporally limited frames. Also, the windowing allows for an optimization of an overlap-and-add process of subsequent temporally shifted but overlapping frames.

In addition, techniques for an efficient encoding of speech signals have been proposed. For example, concepts for a speech coding have been defined in the International Standards 3GPP TS 26.090, 3GPP TS 26.190 and 3GPP TS 26.290. In addition, many additional concepts for an encoding of speech signals have been discussed in the literature.

However, it has been found that it is difficult to combine the concepts for general audio coding (as defined, for example, in the International Standard ISO/IEC 14496-3, part 3, subpart 4) with the concepts for speech coding (as defined, for example, in the above-mentioned 3GPP Standards).

In view of this situation, there is a desire to create concepts which allow for a sufficiently smooth yet bitrate-efficient transition between audio frames encoded in the frequency-domain and audio frames encoded in the linear-prediction-domain.

SUMMARY OF THE INVENTION

This problem is solved by an audio decoder according to claim 1, claim 14 or claim 26, an audio encoder according to claim 11, claim 23 or claim 32, a method for providing a decoded representation of an audio content on the basis of an encoded representation of the audio content according to claim 12, claim 24 or claim 33, a method for providing an encoded representation of an audio content on the basis of an input audio representation of the audio content according to claim 13, claim 25 or claim 34 and by a computer program according to claim 35.

An embodiment according to a first aspect of the invention creates an audio decoder for providing a decoded representation of an audio content on the basis of an encoded representation of the audio content. The audio decoder comprises a linear-prediction-domain decoder core configured to provide a time-domain representation of an audio frame on the basis of a set of linear-prediction-domain parameters. The audio decoder also comprises a frequency-domain decoder core configured to provide a time-domain representation of an audio frame on the basis of a set of frequency-domain parameters, taking into account a transform window out of a set comprising a plurality of different transform windows. The audio decoder also comprises a signal combiner configured to overlap time-domain representations of subsequent audio frames encoded in different domains in order to smoothen a transition between the time-domain representations of the subsequent audio frames. The set of transform windows available for application by the frequency-domain decoder core comprises an insertion window adapted for a generation of a time-domain representation of a frequency-domain-encoded audio frame temporally embedded between a preceding audio frame encoded in the linear-prediction-domain and a subsequent audio frame encoded in the linear-prediction-domain. A left-sided transition slope of the insertion window is adapted to provide for a smooth transition between a time-domain representation of the preceding audio frame encoded in the linear-prediction-domain and the time-domain representation of the current frame encoded in the frequency-domain. A right-sided transition slope of the insertion window is adapted to provide for a smooth transition between the time-domain representation of the current audio frame encoded in the frequency-domain and a time-domain representation of the subsequent audio frame encoded in the linear-prediction-domain.

This embodiment of the invention is based on the finding that it is advantageous to be able to insert a single audio frame (designated here as a "current" audio frame) between a preceding audio frame encoded in the linear-prediction-domain and a subsequent audio frame also encoded in the linear-prediction-domain, and that a smooth transition between said three audio frames should be ensured by using an appropriate insertion window.

It has been found that inserting a single frequency-domain-encoded audio frame between two linear-prediction-domain-encoded audio frames brings along the chance to realistically encode background sound accompanying speech. While it may be most efficient to encode the actual speech in the linear-prediction-domain, a linear-prediction-domain encoding is typically inefficient or even very inefficient for encoding any background noise, which may be dominant during the comparatively short breaks between separate words.

Thus, if it was not possible to introduce a single audio frame encoded in the frequency domain between two audio frames encoded in the linear-prediction-domain, it would either be very bitrate-inefficient to encode the background noise during the short breaks between two words (because such background noise would need to be encoded in the linear-prediction-domain, which is not well-suited for encoding background noise), or the encoding of the background noise would be rather inaccurate (if the background noise would be encoded in the linear-prediction-domain while limiting the bitrate to a low value).

In contrast, the inventive concept, which provides for an appropriate insertion window, allows for the insertion of a single frequency-domain-encoded audio frame between two linear-prediction-domain-encoded audio frames, and consequently allows for a resource-efficient but accurate encoding and decoding of background noise between individual words. While the speech portions are encoded in the linear-prediction-domain, which is best suited for the encoding of speech, the background noise during the breaks (i.e. pauses) between the words is encoded in the frequency-domain, which allows for a bitrate-efficient encoding which is well-adapted to the human perception of such background noise.

Nevertheless, it has been found that a smooth insertion of such a single frequency-domain-encoded audio frame between multiple linear-prediction-domain-encoded audio frames can be performed with good bitrate efficiency using an appropriately-shaped insertion window, the transition slopes of which are shaped in order to smoothen the transitions between the previous linear-prediction-domain-encoded audio frame, the current frequency-domain-encoded audio frame and the subsequent linear-prediction-domain-encoded audio frame.

Another embodiment according to the first aspect of the invention creates an audio encoder for providing an encoded representation of an audio content on the basis of an input audio representation of the audio content. The audio encoder comprises a linear-prediction-domain encoder core configured to provide a set of linear-prediction-domain parameters on the basis of a time-domain representation of an audio frame to be encoded in the linear-prediction-domain. The audio encoder also comprises a frequency-domain encoder core configured to provide a set of frequency-domain parameters on the basis of a time-domain representation of an audio frame to be encoded in the frequency-domain, taking into account a transform window out of a set comprising a plurality of different transform windows. The audio encoder is configured to encode subsequent, overlapping or non-overlapping, audio frames in different domains. The set of transform windows available for application by the frequency-domain encoder core comprises an insertion window adapted for generation of a set of frequency-domain parameters of an audio frame to be encoded in the frequency-domain, which is embedded between a preceding audio frame to be encoded in the linear-prediction-domain and a subsequent audio frame to be encoded in the linear-prediction-domain. A left-sided transition slope of the insertion window is adapted to provide for a smooth transition between a time-domain representation of the preceding audio frame to be encoded in the linear-prediction-domain and a time-domain representation of the current audio frame to be encoded in the frequency-domain. A right-sided transition slope of the insertion window is adapted to provide for a smooth transition between the time-domain representation of the current audio frame to be encoded in the frequency-domain and a time-domain representation of the subsequent audio frame to be encoded in the linear-prediction-domain.

The provision of an insertion window adapted for a smooth transition between a preceding audio frame to be encoded in the linear-prediction-domain, a current audio frame to be encoded in the frequency-domain and a subsequent audio frame to be encoded in the linear-prediction-domain brings along the same advantages as discussed above with respect to the audio decoder. For example, the provision of such an insertion window, which is specifically adapted to allow for the insertion of a single frequency-domain-encoded audio frame between linear-prediction-domain-encoded audio frames, improves the encoding accuracy and bitrate requirement when encoding background noise between words or other speech elements.

Further embodiments according to the invention also create a method for providing a decoded representation of an audio content and a method for providing an encoded representation of an audio content, which methods are based on the ideas discussed before.

Another embodiment according to a second aspect of the invention creates another audio decoder for providing a decoded representation of an audio content on the basis of an encoded representation of the audio content. The audio decoder comprises a linear-prediction-domain decoder core configured to provide a time-domain representation of an audio frame on the basis of a set of linear-prediction-domain parameters. The audio decoder also comprises a frequency-domain decoder core configured to provide a time-domain representation of an audio frame on the basis of a set of frequency-domain parameters, taking into account a transform window out of a set comprising a plurality of different transform windows. The audio decoder also comprises a signal combiner configured to overlap time-domain representations of subsequent audio frames encoded in different domains in order to smoothen a transition between the time-domain representations of the subsequent audio frames. The set of transform windows available for application by the frequency-domain decoder core comprises window types having associated therewith different temporal resolutions and being adapted for a generation of a time-domain representation of a frequency-domain-encoded audio frame such that the time-domain representation of a frequency-domain-encoded audio frame comprises a smooth transition towards a time-domain representation of a linear-prediction-domain-encoded audio frame.

This embodiment of the invention is based on the finding that it is advantageous to have a choice between different temporal resolutions for an encoding and decoding of a frequency-domain-encoded audio frame preceding a linear-prediction-domain-encoded audio frame, and that such flexibility can be obtained by providing a plurality of appropriate window types of different temporal resolutions adapted for a generation of a time-domain representation of a frequency-domain-encoded audio frame, such that the time-domain representation of a frequency-domain-encoded audio frame comprises a smooth transition towards a time-domain representation of a linear-prediction-domain-encoded audio frame. In other words, it has been found that it is desirable to have window types of different temporal resolutions, the right-sided transition slopes of which are specifically adapted for an overlap-and-add with a time-domain-representation of a subsequent linear-prediction-domain-encoded audio frame and typically differ form transition slopes of window types adapted for an overlap-and-add with a time-domain-representation of a subsequent frequency-domain-encoded audio frame.

It has been recognized that an efficient encoding of an audio signal comprising both speech-portions and non-speech-portions (also designated as "general audio"-portions) can be obtained if both a high-temporal-resolution coding and a low-temporal-resolution coding is available for frequency-domain-encoded audio frames preceding a linear-prediction-domain-encoded audio frame. It has been found that in many cases speech-portions are audibly separated (or spaced) from non-speech-portions of an audio content. For example, in processed audio contents, there is often a short time gap between a non-speech-portion (e.g. background noise of a movie) and a beginning of the speech-portion in order to facilitate an understanding of the speech-portion. The same also holds for some artistic pieces of music, in which instrumental music (which is typically encoded in a non-speech-portion) stops shortly before the beginning of a vocal audio content (which is typically encoded in a speech-portion). A high temporal resolution coding of the non-speech portion is desirable in such a case. Nevertheless, it has also been found that in other cases the speech-portion is embedded into the background noise, such that an audible gap between the background noise (non-speech-portion) and the speech content of the speech-portion is avoided. It has been found that a bitrate-efficient encoding of both types of audio content with good audio quality can be obtained by providing the possibility to directly transition to a linear-prediction-domain-encoded audio frame from a frequency-domain-encoded audio frame encoded with high-temporal resolution or from a frequency-domain-encoded audio frame encoded with low temporal resolution. This possibility is opened by providing the audio decoder with appropriate window types of different temporal resolutions, which are adapted for a generation of a time-domain representation of a frequency-domain-encoded audio frame comprising a transition towards a time-domain representation of a linear-prediction-domain-encoded audio frame.

Thus, the audio decoder according to the second aspect of the invention is well-suited for a decoding of a bitrate-efficiently encoded audio content comprising a mixture of non-speech-portions and speech-portions.

Another embodiment according to the second aspect of the invention creates an audio encoder for providing an encoded representation of an audio content on the basis of input audio representation of the audio content. The audio encoder comprises a linear-prediction-domain encoder core configured to provide a set of linear-prediction-domain parameters on the basis of a time-domain representation of an audio frame to be encoded in the linear-prediction-domain. The audio encoder also comprises a frequency-domain encoder core configured to provide a set of frequency-domain parameters on the basis of a time-domain representation of an audio frame to be encoded in the frequency-domain, taking into account a transform window out of a set comprising a plurality of different transform windows. The audio encoder is adapted to encode subsequent, overlapping or non-overlapping, audio frames in different of the domains. The set of transform windows available for application by the frequency-domain encoder core comprises window types of different temporal resolutions adapted for a generation of a set of frequency-domain parameters of an audio frame to be encoded in the frequency-domain and comprising a transition towards a subsequent audio frame to be encoded in the linear-prediction-domain.

This audio encoder is capable of providing the advantages which have already been discussed with respect to the audio decoder according to the second aspect of the invention. In particular, the audio encoder is capable of providing an encoded audio information, in which different types of audio contents comprising both non-speech-portions and speech-portions are encoded with high bitrate efficiency while maintaining the characteristics of a transition from a non-speech-portion to a speech-portion.

Further embodiments according to the second aspect of the invention create a method for providing a decoded audio representation of an audio content and a method for providing an encoded audio representation of an audio content.

Another embodiment according to a third aspect of the present invention creates an audio decoder for providing a decoded representation of an audio content on the basis of an encoded representation of the audio content. The audio decoder comprises a linear-prediction-domain decoder core configured to provide a time-domain representation of an audio frame on the basis of a set of linear-prediction-domain parameters. The audio decoder also comprises a frequency-domain decoder core configured to provide a time-domain representation of an audio frame on the basis of a set of frequency-domain parameters taking into account a transform window out of a set comprising a plurality of different transform windows. The audio decoder also comprises a signal combiner configured to overlap time-domain representations of subsequent audio frames in order to smoothen a transition between the time-domain representations of the subsequent audio frames. The frequency-domain decoder core is configured to selectively provide a time-domain representation of an audio frame on the basis of a high-temporal-resolution set of frequency-domain parameters representing the frequency-domain-encoded audio frame at a comparatively high temporal resolution using a high-temporal resolution window type, or on the basis of a low-temporal-resolution set of frequency-domain parameters representing the frequency-domain-encoded audio frame at a comparatively lower temporal resolution using a low-temporal-resolution transform window type. The set of transform windows available for application by the frequency-domain decoder core comprises a transition window adapted for a generation of a time-domain representation of a current frequency-domain-encoded audio frame, the current frequency-domain-encoded audio frame following a previous audio frame encoded in the frequency-domain using a high-temporal-resolution set of frequency-domain parameters and the current frequency-domain-encoded audio frame comprising a transition towards a time-domain representation of a subsequent linear-prediction-domain-encoded audio frame. A left-sided transition slope of the transition window is adapted to a right-sided transition slope of the high-temporal-resolution window type, and a right-sided transition slope of the transition window is adapted to provide for a smooth transition between the time-domain representation of the current audio frame encoded in the frequency-domain and a time-domain representation of the subsequent audio frame encoded in the linear-prediction-domain.

This embodiment according to the third aspect of the invention is based on the finding that many pieces of audio comprise a transient (for example a step-like reduction of an ambient noise) shortly, but not directly, before a transition from a non-speech-portion towards a speech-portion of the audio content, and that the temporal spacing between the transient and the transition between the non-speech-portion and the speech-portion is often of the order of the duration of an audio frame. Also, it has been found that audio signals are often approximately stationary during an audio frame between said transient and the transition from the non-speech-portion to the speech-portion. For example, a level of a background noise is sometimes significantly reduced approximately 1 to 1.5 audio frames before a transition from a non-speech-portion to a speech-portion, which constitutes a transient of the audio content. Subsequently, the level of the background noise is often approximately constant up to the beginning of the speech-portion. It has been found that such an audio content can be encoded bitrate-efficiently and with good audio quality using a transition window, the transition slopes of which are adapted such that the transition window provides for a smooth transition between a time-domain representation of an audio frame encoded in the frequency-domain using a (comparatively) high temporal resolution and a time-domain representation of the current audio frame encoded in the frequency-domain using a (comparatively) low temporal resolution and also a smooth transition between the time-domain representation of the current audio frame encoded in the frequency-domain using a (comparatively) low temporal resolution and an audio frame encoded in the linear-prediction-domain. Accordingly, it is not necessary to encode the approximately stationary non-speech-portion of an audio content immediately preceding a speech-portion of the audio content using a high-temporal resolution. Rather, a comparatively low temporal resolution can be used for the encoding of the approximately stationary non-speech-portion of the audio content directly preceding the speech-portion of the audio content, thereby keeping the bitrate sufficiently small. Nevertheless, as the transition window preferably comprises a left-sided transition slope adapted to match a right-sided transition slope of a high-temporal-resolution window (having associated therewith spectral coefficients of high temporal resolution), it is possible to encode an audio frame, which is two frames before a first linear-prediction-domain-encoded audio frame, in the frequency-domain using a high-temporal resolution. Thus, the audio coding can be adapted to characteristics of typical audio contents, in which there is a transient slightly before a transition from a non-speech-portion towards a speech-portion.

A further embodiment according to the third aspect of the invention creates an audio encoder for providing an encoded representation of an audio content on the basis of an input audio representation of the audio content. The audio encoder comprises a linear-prediction-domain encoder core configured to provide a set of linear-prediction-domain parameters on the basis of a time-domain representation of an audio frame to be encoded in the linear-prediction-domain. The audio encoder also comprises a frequency-domain encoder core configured to provide a set of frequency-domain parameters on the basis of a time-domain representation of an audio frame to be encoded in the frequency-domain, taking into account a transform window out of a set comprising a plurality of different transform windows. The frequency-domain encoder core is configured to selectively provide a high-temporal-resolution set of frequency-domain parameters representing the audio frame to be encoded in the frequency-domain at a comparatively high-temporal resolution using a high-temporal-resolution window or a low-temporal-resolution set of frequency-domain parameters representing the audio frame to be encoded in the frequency-domain at a comparatively low temporal resolution using a low-temporal-resolution window. The audio encoder is adapted to encode subsequent, overlapping or non-overlapping, audio frames in different domains. The set of transform windows available for application by the frequency-domain encoder core comprises a transition window adapted for a generation of a set of frequency-domain parameters on the basis of a time-domain representation of a current audio frame, the current audio frame following a previous audio frame to be encoded in the frequency-domain using a high-temporal-resolution set of frequency-domain parameters and the current audio frame comprising a transition towards a time-domain representation of a subsequent audio frame to be encoded in the linear-prediction-domain. The audio encoder is capable of efficiently encoding audio contents in which there is a transient shortly, but not directly, before a transition from a non-speech-portion towards a speech-portion.

Further embodiments according to the third aspect of the invention create a method for providing a decoded representation of an audio content and a method for providing an encoded representation of an audio content.

Further embodiments according to the aspects of the invention create computer programs for performing the methods mentioned above.

BRIEF DESCRIPTION OF THE FIGURES

Embodiments of the present invention will subsequently be described with reference to the enclosed figures, in which:

FIG. 5 shows a schematic representation of allowed window sequences;

DETAILED DESCRIPTION OF THE EMBODIMENTS

1. Audio Encoder-General Structure

Figure 1A:
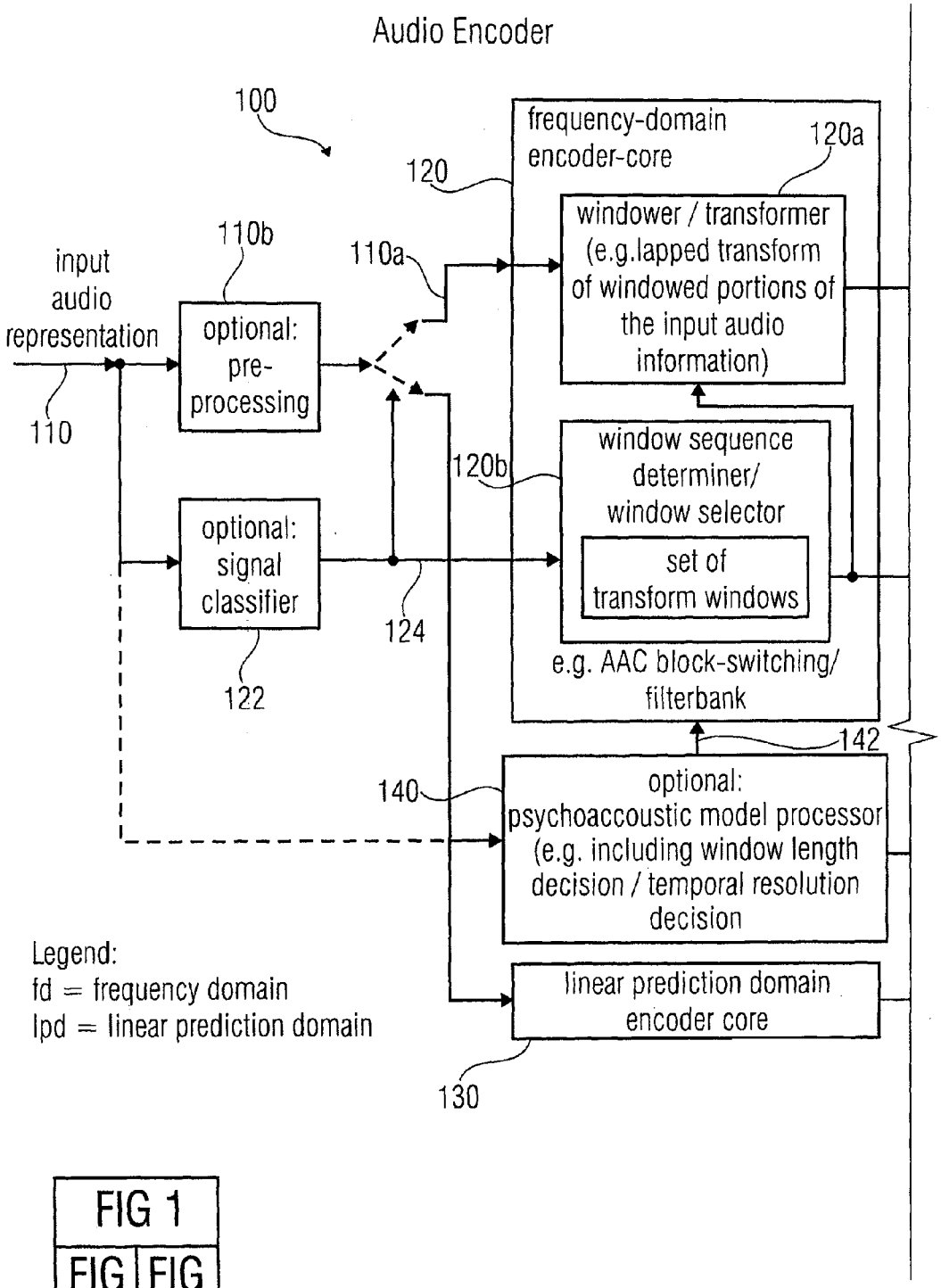
FIG. 1 shows a block schematic diagram of an audio encoder, according to an embodiment of the invention.
Figure 1B:
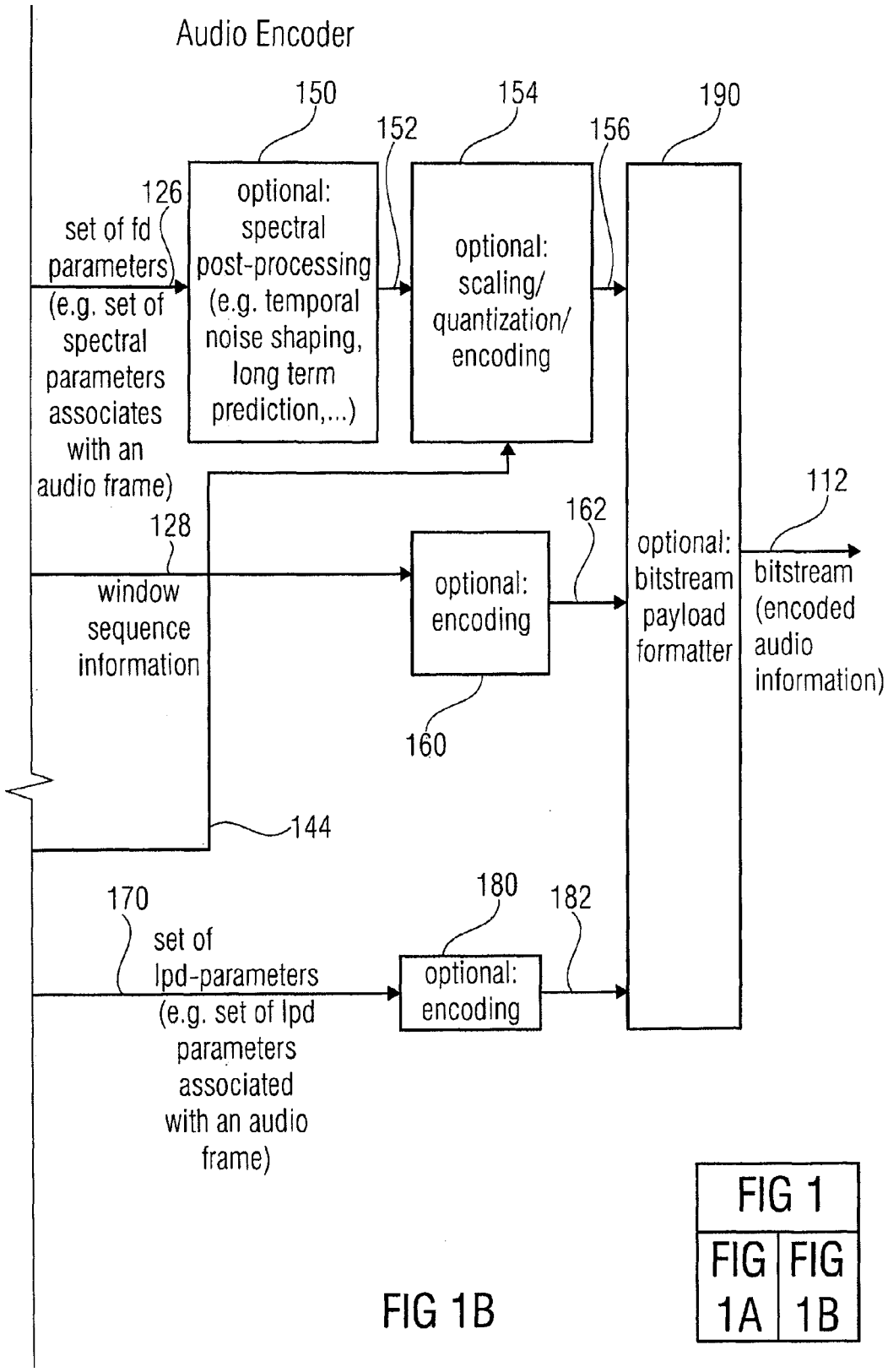

In the following, an audio encoder according to an embodiment of the invention will be described taking reference to FIG. 1, which shows a block schematic diagram of an audio encoder 100. The audio encoder 100 is configured to receive an input audio representation 110 and to provide, on the basis thereof, a bitstream 112 representing an audio content which is described by the input audio representation 110. The audio encoder 100 comprises a frequency-domain encoder core 120 and a linear-prediction-domain encoder core 130. The frequency-domain decoder core 120 is configured to receive the input audio representation 110 or, optionally, a pre-processed version 110*a* thereof. The pre-processed version 110*a* may, for example, be obtained using an optional pre-processor 110*b*. The frequency-domain encoder core 120 is also configured to receive a signal classification information 124, which may be derived from the input audio representation 110 using an optional signal classifier 122, or which may be obtained otherwise. The frequency-domain encoder core 120 is configured to provide a set of frequency-domain parameters 126 associated to an audio frame of the input audio representation 110, 110*a*. For example, the frequency-domain encoder core may be configured to provide a set of spectral parameters (e.g. spectral values) 126 associated with an audio frame of the input audio representation 110, 110*a*. Also, the frequency-domain encoder core 120 is configured to provide a window sequence information 128 describing which transform window has been used for obtaining the set of frequency-domain parameters 126. The audio encoder 100 may further, optionally, comprise a psycho-acoustic model processor 140, which is configured to receive the input audio representation 110, 110*a* and to provide a psycho-acoustic model information 142, 144 on the basis of the input audio representation 110, 110*a*.

The audio encoder 100 also comprises, optionally, a spectral processor 150, which is configured to receive a set of frequency-domain parameters 126, or even a sequence of sets of frequency-domain parameters 126, and to perform a spectral post-processing. For example, the spectral post-processor 150 may be configured to perform a temporal noise shaping and/or a long-term-prediction on the basis of the one or more sets of frequency-domain parameters 126, thereby providing one or more post-processed sets of frequency-domain parameters 152. The audio encoder 100 further comprises an optional scalar/quantizer/encoder 154 configured to scale, quantize and encode the frequency-domain parameters of the set 126 or the post-processed set 152 of frequency-domain parameters. Accordingly, the scalar/quantizer/encoder 154 provides a scaled, quantized and encoded set 156 of frequency-domain parameters.

In addition, the audio encoder 100 may comprise an optional encoder 160 configured to receive the window sequence information 128, to encode the window sequence information 128 and to provide an encoded window sequence information 162.

The linear-prediction-domain encoder core 130 is configured to receive the input audio representation 110 (or the pre-processed version 110*a* thereof) and to provide a set 170 of linear-prediction-domain parameters on the basis thereof. The set 170 of linear-prediction-domain parameters may be associated with an audio frame for which it is found, for example by the signal classifier 122, that the frame is a speech-audio-frame. The set 170 of linear-prediction-domain parameters may be generated by the linear-prediction-domain encoder core 130, such that the set of linear-prediction-domain parameters represents coefficients of a linear-prediction filter and a stimulus of the linear-prediction filter, such that an output of the linear-prediction filter, which is obtainable in response to the stimulus, approximates a speech content of the audio frame input to the linear-prediction-domain encoder core 130. The audio encoder 130 further comprises an optional encoder 180, which is configured to encode the set 170 of linear-prediction-domain parameters, in order to obtain an encoded set 182 of linear-prediction-domain parameters. The audio encoder 100 further comprises an optional bitstream payload formatter 190, which is configured to receive the set 126 of frequency-domain parameters (or, optionally, the spectrally post-processed set 152 of frequency-domain parameters, or, alternatively, the scaled, quantized and encoded set 156 of frequency-domain parameters), the window sequence information 128 (or, alternatively, the encoded window sequence information 152) and the set 170 of linear-prediction-domain parameters (or, alternatively, the encoded version 182 thereof) and to provide a bitstream 112, which represents the audio content of the input audio representation 110 in an encoded form.

Regarding the functionality of the audio encoder 100, it should be noted that the audio encoder 100 is capable of selectively encoding the audio content of the input audio representation 110 in the frequency-domain and in the linear-prediction-domain. Accordingly, it is possible to encode an audio frame (for example an audio frame of 2048 time-domain samples) of the input audio representation 110 in the domain best suited for a bitrate-efficient encoding. For example, general audio contents, like instrumental music and environmental noise, can be encoded with good encoding efficiency (i.e. with a good tradeoff between bitrate and perceptual quality) in the frequency-domain. In contrast, audio frames comprising a speech (or speech-like) audio content (in the following also designated at speech-audio-frames) can be encoded more efficiently (i.e. with a better tradeoff between perceived speech quality and bitrate) in the linear-prediction-domain. For encoding the speech in the linear-prediction-domain, characteristics of the human vocal tract are exploited in order to obtain a bitrate-efficient representation of the linear-prediction filter coefficients. Also, the linear-prediction-domain encoder core 130 is adapted to exploit characteristics of the Epiglottis and the vocal chord in order to provide an efficient representation of the stimulus of the linear-prediction filter.

The audio encoder 100 is configured to handle signals, in which non-speech audio frames (i.e. frames in which a speech content is non-dominant over a general audio content like, for example, instrumental music or environmental noise) and speech-audio-frames (i.e. audio frames, in which a speech content is dominant over a non-speech audio content) are included. Accordingly, different audio frames, which are typically overlapping, and which may comprise, for example, a length of 2048 audio samples, are encoded in different coding domains (frequency-domain or linear-prediction-domain). Accordingly, a set 126, 152, 156 of frequency-domain parameters may be included into the bitstream 112 for a non-speech audio frame (while omitting the inclusion of a set 170, 182 of linear-prediction-domain parameters for such a non-speech audio frame), and a set 170, 182 of linear-prediction-domain parameters may be included into the encoded bitstream 112 for a speech audio frame (while omitting the inclusion of a set 126, 152, 156 of frequency-domain parameters for such a speech audio frame). Accordingly, each audio frame of the input audio representation 110 may be encoded in the domain which is best-suited (for example in the terms of a tradeoff between perceptual quality and bitrate) for the encoding of the respective audio frame.

In the following, some details regarding the frequency-domain encoding and the linear-prediction-domain encoding will be discussed. It should be noted that it is an important aspect of the encoding to avoid blocking artifacts at a transition between subsequent (typically partially overlapping) audio frames encoded in the same domain or encoded in different domains. By putting attention at this issue at the encoder side, a reconstruction of the entire audio signal can be facilitated by avoiding undesirable blocking artifacts.

For non-speech audio frames, the encoded audio information, which is included into the bitstream 112, is generated using the frequency-domain encoder core 120. The frequency-domain encoder core 120 comprises a windower/transformer 120*a*, which is configured to provide the set 126 of frequency-domain parameters on the basis of a time-domain representation of an audio frame of the input audio representation 110, 110*a*. The windower/transformer 120*a* is configured to perform a lapped transform of a windowed portion of the input audio information, preferably of a windowed portion of an audio frame of the input audio representation 110, 110*a*. For example, the windower/transformer 120*a* is configured to perform a modified-discrete-cosine-transform (MDCT) on the basis of a windowed time-domain representation of a given audio frame of the input audio representation 110, 110*a*, thereby obtaining a set of modified-discrete-cosine-transform-parameters, which make up a set 126 of frequency-domain parameters associated with the given audio frame. For example, a set of 1024 MDCT-coefficients may be provided by the windower/transformer 120*a* on the basis of an audio frame having 2048 time-domain samples (even though some of the 2048 time-domain samples of the audio frame may be forced to zero by the windowing). Typically, a number of time-domain samples of the given audio frame considered for the generation of the set of MDCT-coefficients may be larger than the number MDCT-coefficients, thereby creating a so-called time-domain aliasing. However, the time-domain aliasing may be reduced, or even entirely eliminated, by an overlap-and-add operation performed in a corresponding audio decoder, overlapping-and-adding reconstructed time-domain representations of subsequent audio frames.

It is important to note that the windower/transformer may be configured to apply different transform windows, out of a set comprising a plurality of transform windows, before performing the MDCT-transform, or during the application of the MDCT-transform. The application of a transform window smoothens a transition between subsequent audio frames and allows for a smooth overlap-and-add of subsequent audio frames encoded in the frequency-domain. For example, the windowing may be performed such that in an overlap region, in which there is an overlap between subsequent audio frames, audio samples are weighted less with increasing distance from the center of the current audio frame (for which the windowing is currently performed). Thus, in a left-sided portion of an overlap region (wherein the term "left-sided" is used synonymously with "temporarily earlier") between a current audio frame and a subsequent audio frame, time-domain samples are weighted higher for obtaining the MDCT-parameters of the current audio frame than for obtaining the MDCT-parameters of the subsequent audio frame. In contrast, in a right-sided portion of an overlap region (when the term "right-sided" is used synonymously with "temporarily later") between the current audio frame and the subsequent audio frame, the time-domain samples are weighted higher for the generation of the MDCT-coefficients of the subsequent audio frames than for the generation of the MDCT-coefficients of the current audio frame.

Typically, different window types are available for encoding subsequent audio frames to be encoded in the frequency domain. For example, window types of different temporal resolutions are available, which comprise transition regions (for example in the form of transition slopes) of different lengths. Also, dedicated window types are typically available for switching between different temporal resolutions. Also, the inventive audio encoder 100 comprises a plurality of window types that fit for providing a smooth transition between audio frames encoded in different domains (e.g. frequency-domain and linear-prediction-domain) as will be discussed in detail in the following.

The frequency-domain encoder core typically comprises a window sequence determiner/window selector 120*b*, which is configured to receive the signal classification information 124 from the signal classifier 122, and to select a window type from a set comprising a plurality of window types (or a plurality of transform windows). Accordingly, the window sequence determiner/window selector 120*b* provides the window sequence information 128, which is evaluated by the windower/transformer 120*a* in order to perform an appropriate windowing information before the MDCT-transform or during the MDCT-transform.

The window sequence determiner/window selector 120*b* is preferably configured to take into consideration a window type used for a provision of the MDCT-coefficients of a previous audio frame, if the previous audio frame was encoded in the frequency-domain. In addition, the window sequence determiner 120*b* takes into consideration a signal classification information 124 indicating whether the previous audio frame was encoded in the frequency-domain or in the linear-prediction-domain. Furthermore, the window sequence determiner 120*b* typically takes into consideration a signal classification information 124 indicating a temporal resolution which should be applied for encoding the current audio frame, and also a temporal resolution which should be used for encoding a subsequent audio frame. Thus, the window sequence determiner/window selector 120*b* is preferably configured to adapt a window type to be used for providing the MDCT-coefficients of the current audio frame to the domain, in which the previous audio frame has been encoded, and to the domain in which the subsequent audio frame is to be encoded. In addition, the window sequence determiner 120*b* is typically configured to take into account a temporal resolution (or associated window shape) of the adjacent audio frames (i.e. the previous audio frame and the subsequent audio frame), if any of the adjacent audio frames is encoded in the frequency-domain. Specific details regarding the selection of the transform windows will be discussed subsequently, also taking reference to FIGS. 2, 3, 4*a*-4*d*, 5 and 6*a*-*d*.

In addition, it should be noted that the basic functionality of the preprocessor 110*b*, of the frequency-domain encoder core 120, of the spectral post-processor 150 and of the scaler/quantizer/encoder 154 is similar to the functionality of the components "AAC gain control", "block switching/filter bank", "TNS", "long term prediction", "intensity", "prediction", "PNS", "M/S" and "AAC: scaling/quantization/Huffman coding" described in the International Standard ISO/IEC 14496-3, part 3, subpart 4 and the related literature. Accordingly, the bitstream provided by the scalar/quantizer/encoder 154 may be similar to (or even, in some cases, identical to) the information provided by the block "AAC: scaling/quantization/Huffman coding" of the audio decoder described in said standard and the related literature.

Nevertheless, the audio encoder 100 provides for the additional possibility to encode audio frames in the linear-prediction-domain, thereby providing the set 170, 182 of linear prediction domain parameters. The set 170, 182 of the linear-prediction-domain parameters may be similar to (or even identical to) a set of linear-prediction-domain parameters provided by an audio encoder according to one of the standards 3GPP TS 26.090, 3GPP TS 26.190 or 3GPP TS 26.290. Nevertheless, the set 170, 182 of linear-prediction-domain parameters may be similar to (or even identical to) any other set of linear-prediction-domain parameters provided by a speech audio coder.

2. Audio Decoder—General Structure

Figure 2A:
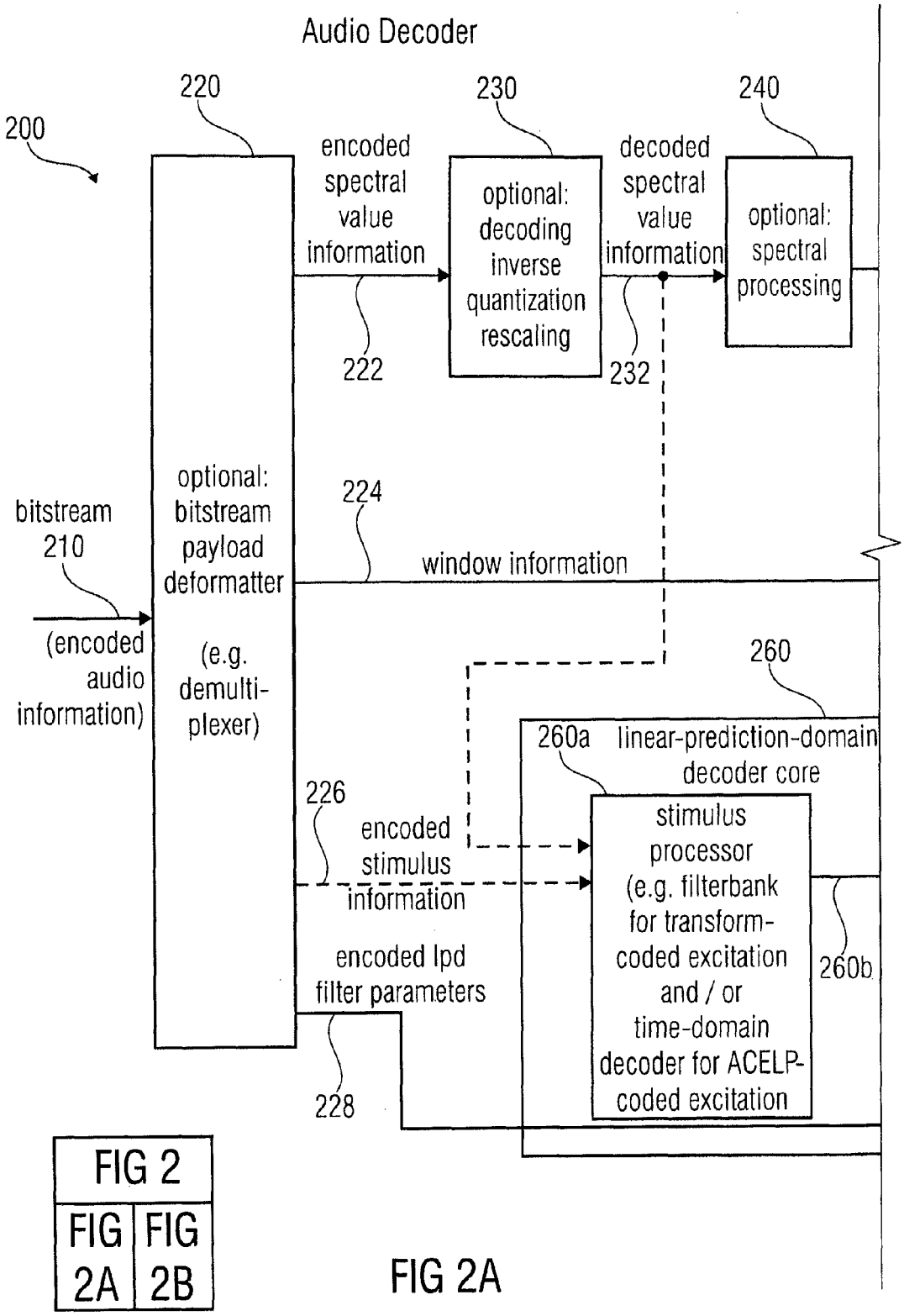
FIG. 2 shows a block schematic diagram of an audio decoder, according to an embodiment of the invention.
Figure 2B:
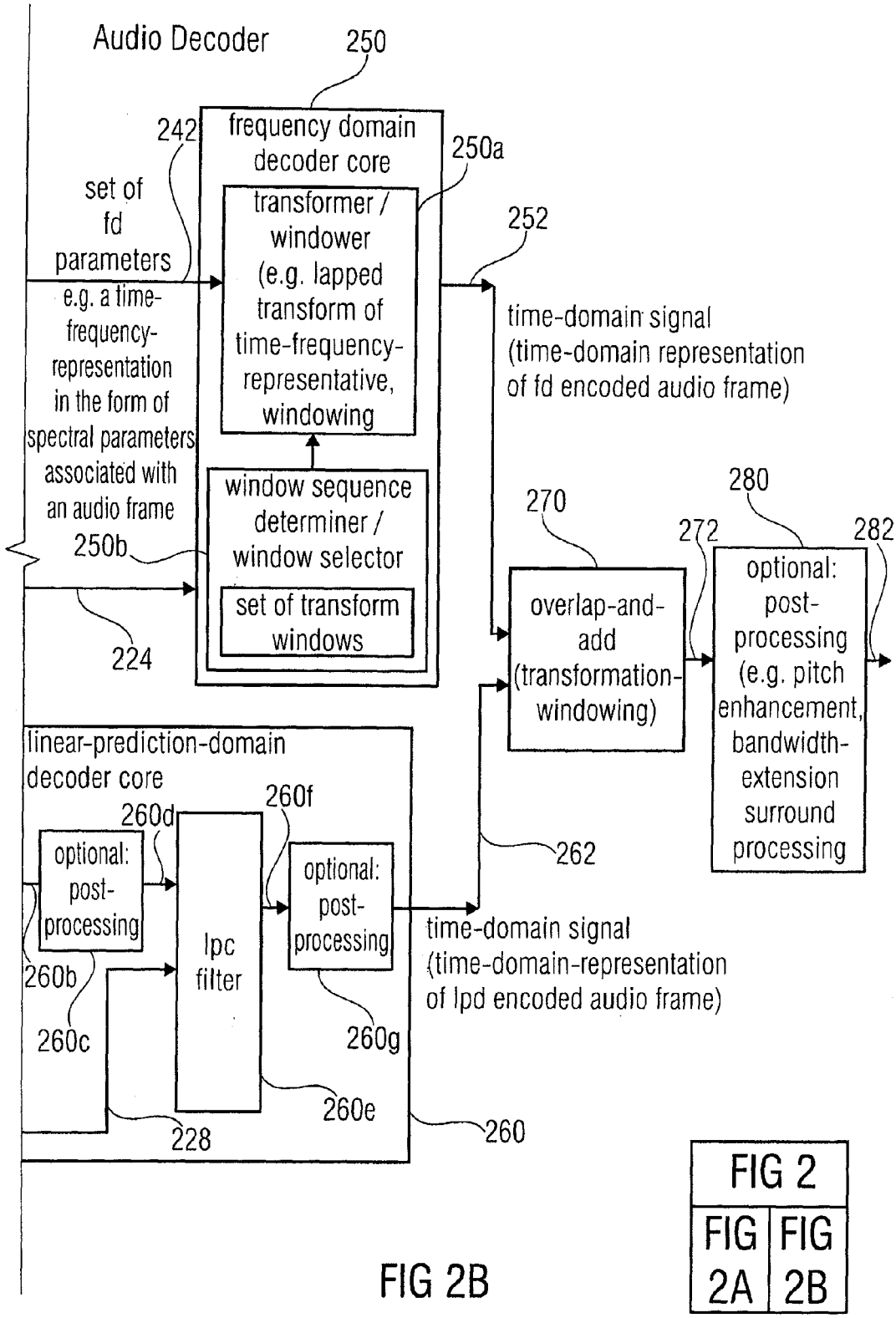

In the following the structure of an audio decoder according to the embodiments of the present invention will be described taking reference to FIG. 2, which shows a block schematic background of such an audio decoder 200. The audio decoder 200 is configured to receive a bitstream 210, which may carry an encoded audio information. The bitstream 210 may be identical to the bitstream 112 provided by the audio encoder 100. The audio decoder 200 comprises an optional bitstream payload deformatter 220, which is configured to parse the bitstream 210 and to extract different information items from the bitstream 210. For example, the bitstream payload deformatter 220 is configured to extract an encoded spectral value information 222 from the bitstream 210. Additionally, the bitstream payload deformatter 220 is configured to extract a window information 224 from the bitstream 210, to extract an encoded stimulus information 226 from the bitstream 210 and to also extract encoded linear-prediction-domain filter parameters 228 from the bitstream 210. However, it should be noted that it is not required that all the information items 222, 224, 226, 228 are extracted for each audio frame. In some cases, the encoded stimulus information 226 may even be omitted completely, if the stimulus is encoded using the encoded spectral value information 226 (transform-coded-excitation).

The audio decoder 200 comprises an optional decoder/inverse quantizer/rescaler 230, which is configured to receive the encoded spectral value information 222 and to decode the encoded spectral value information 222, for example by performing an arithmetic decoding algorithm. Also, the decoder/inverse quantizer/rescaler 230 may be configured to perform an inverse quantization of the decoded spectral value information (for example by using an inverse quantization algorithm) and a rescaling (for example by applying the scale factors or inverse scale factors to the decoded and inversely quantized spectral value information). Accordingly, the decoder/inverse quantizer/rescaler 230 provides a decoded, inversely quantized and rescaled spectral value information 230 on the basis of the encoded spectral value information 222.

The audio decoder 230 also comprises an optional spectral preprocessor 240, which is configured to perform a spectral preprocessing of the decoded spectral value information 232 in order to obtain a preprocessed set 242 of frequency-domain parameters associated with an audio frame (or a sequence of audio frames). For example, the set 242 of frequency-domain parameters may be part of a time-frequency-representation of an audio content in the form of a set of spectral parameters (or values) associated with an audio frame. For example, the set 242 of frequency-domain parameters may comprise a set of MDCT-coefficients associated with an audio frame and determined, for example, by the frequency-domain encoder core 120 of the audio encoder 100. The audio decoder 200 comprises a frequency-domain decoder core 250, which is configured to receive the set 242 of frequency-domain parameters and also the window information 224 (or any equivalent information describing a window to be applied by the frequency-domain decoder core 250). The frequency-domain decoder core 250 is also configured to provide a time-domain representation 252 of the audio content of an audio frame on the basis of the set 242 of frequency-domain parameters associated with the audio frame and the window information 224. For this purpose, the frequency-domain decoder core 250 comprises a transformer/windower 250*a*, which is configured to perform a lapped transform of the set 242 of frequency-domain parameters in order to derive the time-domain representation 252 from the set 242 of frequency-domain parameters. The transformer/windower 250*a* may be configured to also perform a windowing using a transform window out of a set comprising a plurality of transform windows. In order to select an appropriate transform window, the frequency-domain decoder core 250 preferably comprises a window sequence determiner/window selector 250*b*, which is configured to select an appropriate transform window on the basis of the window information 224 (or any equivalent information). The windowing may be applied during the lapped transform (i.e. using a combined transform/windowing operation) or subsequent to the lapped transform (i.e. using a separate windowing operation after the lapped transform operation). Details regarding the choice of the appropriate transform window will be discussed subsequently, taking reference to FIGS. 3, 4*a*-4*d*, 5 and 6*a*-6*d*.

The audio decoder 200 also comprises a linear-prediction-domain decoder core 260, which is configured to receive the encoded linear-prediction-domain filter parameters 228 and the stimulus information. For example, the linear-prediction-domain decoder core may be configured to receive the decoded spectral value information 232 as a stimulus information describing a transform-coded-excitation of a linear-prediction filter. Alternatively, the linear-prediction-domain decoder code 260 may receive the encoded dedicated stimulus information 226, which may represent a stimulus of the linear-prediction filter using a so-called CELP concept or a so-called ACELP concept. For details regarding the encoding of the stimulus, reference is made, for example, to the above mentioned 3GPP standards, in which an encoding of a stimulus of a linear-prediction filter for a speech coding/decoding is described. The linear-prediction-domain decoder core 260 preferably comprises a stimulus processor 260*a*, which is configured to receive the stimulus information 232, 226 and to provide a time-domain stimulus signal 260*b* on the basis of the stimulus information 232, 226. For example, the stimulus processor 260*a* may comprise a filter bank for providing the time-domain stimulus signal 260*b* on the basis of the decoded spectral value information 232 in the case of a transform-coded-excitation. Alternatively, or in addition, the stimulus processor 260*a* may comprise a time-domain decoder in order to provide the time-domain stimulus signal 260*b* on the basis of the encoded dedicated stimulus information 226, for example in the case of a CELP-coded or ACELP-coded excitation. The linear-prediction-domain decoder core 260 additionally comprises an optional stimulus post-processor 260*c*, which is configured to receive the time-domain stimulus signal 260*b* and to provide a post-processed version 260*d* of the time-domain stimulus signal. The linear-prediction-domain decoder core 260 also comprises a linear-prediction-coding filter 260*e*, which is configured to receive the encoded linear-prediction-domain filter parameters 228 (or decoded linear-prediction-domain filter parameters) and the time-domain stimulus signal 260*b*, 260*d*. The linear-prediction-coding filter 260*e* is configured to perform an adjustable linear-prediction filtering in dependence on the encoded linear-prediction-domain filter parameters 228 (or decoded linear-prediction-domain filter parameters derived therefrom) and to provide a synthesis signal 260*f* by filtering the time-domain excitation signal 260*b*, 260*d* using a linear-prediction filter operation adjusted in accordance with the encoded linear-prediction-domain filter parameters 228. In addition, the linear-prediction-domain decoder core 260 comprises an optional post-processor 260*g*, which is configured to receive and post-process the synthesis signal 260*f* and to provide a time-domain signal 262.

The audio decoder 200 further comprises an overlap-and-add processor 270, which is configured to receive the time-domain representation 252 of frequency-domain-encoded audio frames and the time-domain representation 262 of linear-prediction-domain-encoded audio frames, and to overlap-and-add time-domain representations of subsequent audio frames, thereby providing a continuous time-domain representation 272 of the encoded audio information represented by the bitstream 210.

The audio decoder 200 further comprises, optionally, a post-processor 280, which is configured to receive the continuous time-domain representation 272 of the audio content and to perform a post-processing, thereby obtaining a post-processed continuous time-domain representation 282 of the audio content. The post processor 280 may for example be configured to perform a pitch enhancement, a bandwidth extension and/or a surround processing.

The audio decoder 200 is configured to provide for a smooth transition between time-domain representations of audio frames encoded in different domains (frequency-domain and linear-prediction-domain) by an appropriate cooperation between the frequency-domain decoder core 250, the linear-prediction-domain decoder core 260 and the overlap-and-add processor 270.

In particular, the frequency-domain decoder core 250 is configured to apply transform windows, which are specifically adapted for different sequences of domains, in which subsequent audio frames are encoded. Also, the transition slopes of the transform windows, which are available for application by the transformer/windower 250*a*, and which are selected by the window sequence determiner/window selector 250*b*, are adapted to a specific sequence of domains, in which the subsequent audio frames are encoded, as will be discussed in detail in the following.

3. Window Sequences and Transform Windows

In the following, details regarding the available window sequences and transform windows will be described taking reference to FIGS. 3, 4*a*-4*d*, 5 and 6*a*-6*d*. It should be noted that the window sequences and transform windows may be applied both in the windower/transformer 120*a* of the audio encoder 100 and in the transformer/windower 250*a* of the audio decoder 200. However, a more detailed discussion will be given regarding the case of the audio decoder, because the usefulness of the different window sequences and transform windows can be understood more easily in the context of the audio decoder 200. Nevertheless, the explanations given here with regard to the audio decoder 200 can be applied analogously for the case of the audio encoder 100.

3.1. Window Type Overview

Figure 3A:
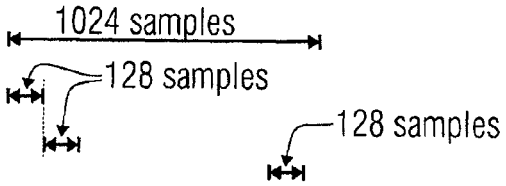
FIG. 3 shows a graphic representation of the window sequences and transform windows for application by the audio encoder of FIG. 1 and the audio decoder according to FIG. 2.
Figure 3B:
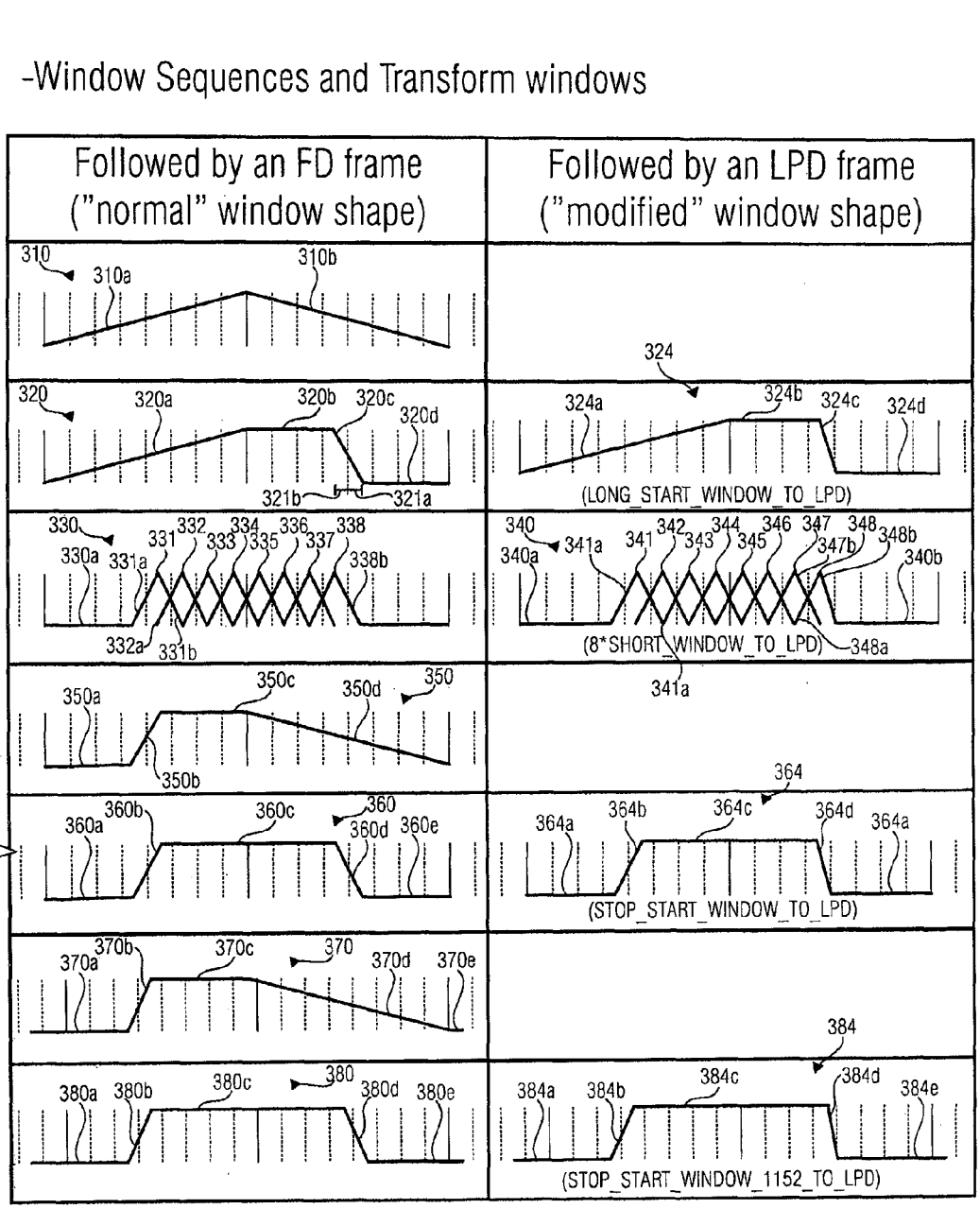

FIG. 3 shows a schematic representation of window sequences and transform windows, some or all of which may be available for the use by the windower/transformer 120*a* or the transformer/windower 250*a* in different embodiments of the invention.

Regarding the notation of FIG. 3, it should be noted that an abscissa (for example in a direction from the left of the paper to the right of the paper) describes a time, and that an ordinate (for example in a vertical direction from the bottom of the page to the top of the page) describes a magnitude of a window's value.

A horizontal portion of a window shape describes a region of (at least approximately) constant magnitude of the window shape. A linearly ascending portion of the window shape describes a steady increase of the magnitude of the window shape, wherein the increase does not necessarily need to be linear. Rather, a linear ascent of the window shape describes any steadily increasing window shape, which is suited (or adapted) for performing an aliasing-reducing (or aliasing-canceling) overlap-and-add between time-domain representations of adjacent audio frames. For example, a linearly ascending window shape may represent a sine-type or cosine-type increasing window shape. Similarly, a linearly descending window shape represents any steadily-decreasing window shape, which is suited (or adapted) for an aliasing reducing (or aliasing canceling) overlap-and-add between time-domain representations of subsequent windowed audio frames. Accordingly, a linearly descending window shape represents, for example, a sine-type or cosine-type window shape decreasing in magnitude with increasing time. Alternatively, a linearly ascending window shape or a linearly descending window shape may represent an increasing or decreasing Kaiser-Bessel-derived window shape. Nevertheless, other non-linearly increasing or non-linearly decreasing window shapes may be represented by the linearly ascending window shape and the linearly descending window shape.

In addition, it should be noted that time intervals are marked in the window representations by thin, solid vertical lines and thin hatched vertical lines. A distance between two adjacent thin solid vertical lines is 1024 samples, a distance between two adjacent thin hatched vertical lines is 128 samples, and a distance between a thin solid vertical line and an adjacent thin hatched vertical line is 128 samples. A temporal duration of a "normal" audio frame is 2048 samples. A time shift between two adjacent audio frames is 1024 samples, such that a left half of a current audio frame overlaps with a right half of a preceding audio frame, and such that a right half of the current audio frame overlaps with a left half of the subsequent audio frame. Herein, the terms "left" and "right" are used to designate a temporally earlier (left) element (e.g. audio sample or portion of a transform window) and a temporarily later (right) element (e.g. audio sample or portion of a transform window).

Taking reference now to FIG. 3, it can be seen that the windower/transformer 120*a* or the transformer/windower 250*a* may be capable to apply a transform window out of, for example, up to 11 different available transform windows. However, there are embodiments, in which more different transform windows are available, and there are also embodiments in which not all of the transform windows shown in FIG. 3 are available.

Furthermore, it can be seen from FIG. 3 that there are 7 "basic types" of transform windows, which are designated with "long_window", "long_start_window", "8*short_window", "long_stop_window", "stop_start_window", "stop_window_1152" and "stop_start_window_1152". However, some of the window types mentioned before, namely the window types "long_start_window", "8*short_window", "stop_start_window" and "stop_start_window_1152" can be applied before a subsequent linear-prediction-domain-encoded audio frame.

However, it has been found that different actual window shapes should be used in dependence of whether a window of the basic window type "long_start_window", "8*short_window", "stop_start_window" or "stop_start_window_1152" is followed by a frequency-domain-encoded audio frame or a linear-prediction-domain-encoded audio frame. Accordingly, two different window shapes are available for the window type "long_start_window", namely a "normal" window shape, used if the subsequent audio frame is encoded in the frequency-domain, and a "modified" window shape (also designated as "long_start_window_to_LPD"), used if the current frame is followed by an audio frame encoded in the linear-prediction-domain. Similarly, two actual window shapes are available for the window type "8*short_window", namely a "normal" window shape, used if the current frame is followed by a frequency-domain-encoded audio frame, and a "modified" window shape (also designated as "8*short_window_to_LPD"), used if the current audio frame is followed by a linear-prediction-domain-encoded audio frame. Also, two actual window shapes are available for the window type "stop_start_window", namely a "normal" window shape, used if the current audio frame is followed by a frequency-domain-encoded audio frame, and a "modified" window shape (also designated as "stop_start_window_to_LPD"), used if the current audio frame is followed by a linear-prediction-domain-encoded audio frame. Similarly, two different window shapes are available for the window type "stop_start_window_1152", namely a "normal" window shape, used if the current audio frame is followed by a frequency-domain-encoded audio frame, and a "modified" window shape (also designated as "stop_start_window_1152_to_LPD"), used if the current audio frame is followed by a linear-prediction-domain-encoded audio frame.

For the window types "long_window", "long_stop_window" and "stop_window_1152", only a "normal" window shape is available in some embodiments, because said window types are not suited for audio frames followed by a linear-prediction-encoded audio frame.

In the following, some details regarding the available window types will be discussed.

The window type "long_window" is only available in a "normal" window shape version 310, which comprises a left-sided transition slope 310*a* of length 1024 time-domain samples and a right-sided transition slope 310*b* of length 1024 time-domain samples.

The window type "long_start_window" is available in a "normal" window shape version 320 and a "modified" window shape version 324. The "normal" window shape version 320 of window type "long_start_window" comprises a left-sided transition slope 320*a* of length 1024 time-domain samples and a right-sided constant window portion 320*b* of length 448 time-domain samples, a right-sided transition slope 320*c* of transition length 128 time-domain samples and a right-sided zero portion of length 448 time-domain samples. The right-sided transition portion 320*c* extends from a left half of the right-sided portion (or half) of the transform window to the right half of the right-sided portion of the transform window. Thus, the right-sided transition slope 320*c* is adapted for performing, in an audio decoder, an overlap-and-add operation between two windowed time-domain representations of subsequent audio frames. Further assuming that the number of MDCT coefficients associated with the transform window 320 (for example 1024 MDCT coefficients) is significantly smaller than the number of time-domain samples associated with the transform window 320 (e.g. 2048), it can be understood that a time-domain aliasing is introduced by the comparatively small number of MDCT coefficients. Thus, a MDCT transform of an audio frame windowed by the transform window 320 results in MDCT coefficients comprising a time-domain aliasing in that time-domain samples located in the right half of the right-sided portion of the transform window 320 are folded back to the left half of the right-sided portion of the transform window 320. Accordingly, said samples from the right half of the right-sided portion of the transform window 320 are folded back from a temporal portion 321*a* to a temporal portion 321*b*. However, this aliasing (folding of time-domain samples from one region of the transform window to another region of the transform window) can be compensated by an overlap-and-add operation of an audio decoder, as it is known, for example, from the international standard ISO/IEC 14496-3, part 3, subpart 4 and the corresponding literature.

However, there is also a "modified" window shape version 324 of the window type "long_start_window", which is used (for example by the audio encoder 100 or the audio decoder 200) for a windowing of time-domain samples of a current frame encoded in the frequency-domain (or to be encoded in the frequency-domain) if (and only if) the subsequent audio frame is encoded (or is to be encoded) in the linear-prediction domain. The "modified" window shape version 324 of the window type "long_start_window" comprises a left-sided transition slope 324*a* of length 1024 audio samples, which may, for example, be identical to the left-sided transition slope 320*a* of the "normal" window shape version of window type "long_start_window". Similarly, the "modified" window shape version 324 of window type "long_start_window" comprises a constant (non-zero) portion 324*b* of length 448 time-domain samples, which may be identical to the constant portion 322*b*. Furthermore, the "modified" window shape version of window type "long_start_window" comprises a right-sided transition slope 324*c* of transition length 64 time-domain samples (which is shorter than the length of the right-sided transition slope of the window type 320). The right-sided transition slope 324*c* is entirely included in a left-sided half of the right-sided portion of the transform window 324. In addition, the transform window 324 comprises a right-sided zero portion 324*d* of length 512 time-domain samples, which fills the entire right-sided half of the right portion of the window shape 324. Accordingly, the window shape 324 avoids an aliasing of time-domain samples from the right-sided half of the right portion of the transform window 324 to the left half of the right-sided portion of the transform window 324, if a modified-discrete-cosine-transform providing, for example, 1024 MDCT coefficients is applied to an audio frame of length, for example, 2048 time-domain samples, which audio frame is windowed by the transform window 324, because time-domain samples lying in the right half of the right-sided portion of the transform window 324, which would be folded back to the left half of the right-sided portion of the transform window 324 are entirely forced to zero by the right-sided zero portion 324*b* of the transform window 324 (because the right-sided zero portion 324*d* extends across the entire right half of the right-sided portion of the transform window 324). Accordingly, the temporal portion of the transform window 324 which comprises the right-sided transition slope 324*c*, is left unaffected by a time-domain aliasing, such that it is unnecessary to perform, at the side of a decoder, an aliasing cancellation during the temporal portion in which the right-sided transition slope 324*c* extends.

Thus, a transition between an audio frame encoded in the frequency-domain and a subsequent audio frame encoded in the linear-prediction-domain is facilitated by a shortening of the right-sided transition slope 324*c* of the "modified" window shape version 324 of the window type "long_start_window" when compared to the right-sided transition slope 320*c* of the "normal" window shape version 320 of the type "long_start_window". The "modified" window shape version 324 is adapted such that a right-sided aliasing is avoided, thereby eliminating the need for an alias cancellation at the decoder side in the case of a transition from a frequency-domain-encoded audio frame to a linear-prediction-domain-encoded audio frame.

The available set of transform windows further comprises a "normal" window shape version 330 of window type "8*short_window". The transform window 330 comprises a left-sided zero portion 330*a* of length 448 time-domain samples and a plurality of, for example, 8 sub-windows 331-338. Each of the sub-windows 331-338 comprises a left-sided transition slope (for example designated with 331*a*) and a right-sided transition slope (for example designated with 331*b*). As can be seen, the sub-windows 331-338 are temporally shifted with respect to each other, such that a right-sided transition slope (e.g. designated with 331*b*) of a given sub-window overlaps with left-sided transition slope (e.g. designated with 332*a*). A "short" set of MDCT coefficients, for example of 128 MDCT coefficients, is associated with each of the sub-windows 331-338, and each of the sub-windows 331-338 comprises a temporal extension of 256 time-domain samples. Accordingly, a representation of an audio content within the temporal duration of one of the sub-windows 331-338, which comprises only 128 MDCT coefficients, comprises aliasing. Nevertheless, when performing (e.g. in the audio decoder 200) an overlap-and-add operation of time-domain representations of the audio contents described by the sets of MDCT coefficients associated with two sub-windows (e.g. sub-windows 331 and 332), aliasing artifacts within the overlap regions of the adjacent sub-windows (e.g. sub-windows 331 and 332) are canceled. In addition, it should be noted that a left-sided transition slope 331*a* of a first, left-sided sub-window 331 extends into the left half of the left-sided portion of the transform window, and that the right-sided transition slope 338*b* of the last, right-sided sub-window 338 extends into the right half of the right-sided portion of the transform window (of the current audio frame) 330. This is reflected by the fact that the left-sided transition slope 331*a* of the first sub-window 331 comprises a temporal duration of, for example, 128 time-domain samples, which is identical to the temporal duration (e.g. 128 time-domain samples) of the right-sided transition slope 338*b* of the last, right-sided sub-window 338. In other words, there is an aliasing within the temporal region of the left-sided transition slope 331*a* of the first sub-window 331, and there is also an aliasing within the temporal region of the right-sided transition slope 338*b* of the last, right-sided sub-window 338, such that an aliasing cancellation is required at the decoder side both in the temporal region of the left-sided transition slope 331*a* and in the region of the right-sided transition slope 338*b*. This aliasing cancellation can be obtained, for example, by an overlap-and-add operation.

In the following, details regarding the "modified" window shape version 340 of the window type "8*short_window" will be discussed. The so-called "transition window" 340 comprises a left-sided zero portion 340*a* having a temporal duration of, for example, 448 time-domain samples. The transform window 340 further comprises a plurality of, for example, 8 sub-windows 341-348. Also, the transform window 340 comprises a right-sided zero portion 340*b* of temporal duration 512 time-domain samples. It should be noted here that the temporal extension of the right-sided zero portion 340*b* is longer (e.g. 512 time-domain samples) than the temporal extension of the left-sided zero portion 340*a* (e.g. 448 time-domain samples). In addition, it should be noted that the right-sided zero portion 340*b* covers the entire right half of the right-sided portion of the transform window 340, while the left-sided zero portion 340*a* is temporally shorter than the left half of the left-sided portion of the transform window 340.

Regarding the sub-windows 341-348, it should be noted that a first, left-sided sub-window 341 comprises a temporally longer extension (for example 256 time-domain samples) than a last, right-sided subwindow 348 (e.g. 192 time-domain samples). This is due to the fact that a left-sided transition slope 341*a* of the first, left-sided subwindow 341 comprises a longer temporal extension (e.g. 128 time-domain samples) than a right-sided transition slope 348*b* (e.g. 64 time-domain samples) of the last, right-sided sub-window 348. The transition slope 348*b* of the last, right-sided subwindow 348 is entirely included in the left half of the right-sided portion of the transition window 340 and does not extend into the right half of the right-sided portion of the transition window 340. It should be noted that the first, left-sided sub-window 340 preferably comprises the same window shape as the central sub-windows 342-347. Also, it should be noted that the sub-windows (preferably all of the sub-windows 341-348) comprise transition slopes which are adapted such that there is an aliasing cancellation when overlapping (e.g. in the audio decoder 200) time-domain representations of audio contents associated with subsequent sub-windows.

Specifically, a right-sided transition slope 347*b* of the last central subwindow 347 preceding the last sub-window 348 is adapted to a left-sided transition slope 348*a* of the last sub-window 348. However, while the right-sided transition slopes 341*b*-347*b* of the sub-windows 341-347 comprise identical temporal durations and shapes, the right-sided transition slope 348*b* of the last sub-window 348 comprises a comparatively shorter temporal duration.

By providing the last subwindow 348 of the "modified" window shape 340 of the window type "8*short_window" with a shorter temporal duration, aliasing artifacts during the temporal duration of the right-sided transition slope 348*b* of the last subwindow 348 are avoided. Accordingly, it is unnecessary to perform an aliasing cancellation during the temporal duration of the right-sided transition slope 348*b* of the last subwindow 348. Accordingly, an aliasing cancellation can be omitted when overlapping-and-adding a time-domain representation decoded using the "modified" window shape version 340 of window type "8*short_window" with a time-domain representation of an audio frame decoded in the linear-prediction-domain. Rather, a simple cross-fade may be performed during the temporal duration of the right-sided transition slope 348*b* of the last subwindow 348 between a time-domain representation of an audio frame decoded using the transform window 340 and a subsequent audio frame decoded in the linear-prediction-domain.

In the following, the "normal" window shape version of window type "long_stop_window", which is designated with 350, will be described. The transform window 350 comprises a left-sided zero portion 350*a*, which comprises a temporal duration of 448 time-domain samples. The window shape 350 further comprises a left-sided transition slope 350*b*, which comprises a temporal duration of 128 time-domain samples, and which extends in both a left half of the left-sided portion of the transform window 350 and in the right half of the left-sided portion of the transform window 350, such that there is typically an aliasing when transforming 2048 time-domain samples windowed by the transform window 350 into the frequency domain to obtain 1024 MDCT-coefficients. It can be the transform window 350 further comprises a left-sided constant portion 350*c* of temporal duration 448 time-domain samples, which extends in the right half of the left-sided portion of the transform window 350. In addition, the transform window 350 comprises a right-sided transition slope 350*b* of temporal duration 1024 time-domain samples, which extends in the right-sided portion of the transform window 350.

In the following, a "normal" window shape version of window type "stop_start_window", which is designated with 360, will be described. Transform window 360 comprises a left-sided zero portion 360*a* of temporal duration 448 time-domain samples and a left-sided transition slope 360*b* of temporal duration 128 time-domain samples, which extends in both a left-sided half and a right-sided half of the left-sided portion of the transform window 360, such that there is an aliasing and a need for an aliasing cancellation in an audio decoder 200. The transform window 360 also comprises a central (non-zero) constant portion 360*c*, which has a temporal duration of, for example, 896 time-domain samples. The transform window 360 further comprises a right-sided transition slope 360*d* of temporal duration 128 time-domain samples, which extends in both the left-sided half and the right-sided half of the right-sided portion of the transform window 360. In addition, the transform window 360 comprises a right-sided zero portion 360*e* of temporal duration 448 time-domain samples, which extends in the right-sided half of the transform window 360.

The transition slopes 360*b*, 360*d* of the transform window 360 are adapted such that an audio frame, the MDCT-coefficients of which are obtained using the transform window 360, can be interposed between a previous audio frame, the MDCT-coefficients of which are obtained using the transform window 330, and a subsequent audio frame, the MDCT-coefficients of which are obtained using the transform window 330, wherein an appropriate aliasing cancellation is ensured by a match of the right-sided transition slope 338*b* with the left-sided transition slope 360*b*, and also by a match of the right-sided transition slope 360*d* with the left-sided transition slope 331*a* (in that the transition slopes are adapted for an aliasing-canceling smooth transition).

In the following, the "modified" window shape version 364 of window type "stop_start_window" will be described. The transform window 364 comprises a left-sided zero portion 364*a*, which is identical to the left-sided zero portion 360*a* of the transform window 360, a left-sided transition slope 364*b*, which is identical to the left-sided transition slope 360*b* of the transform window 360, and a central portion 364*c*, which is identical to the central portion 360*c* of the transform window 360. However, a right-sided transition slope 364*d* of the transform window 364 is shortened to a temporal duration of 64 time-domain samples when compared to the right-sided transition slope 360*d* of the transform window 360, which comprises a temporal duration of 128 time-domain samples. It should be noted that the right-sided transition slope 364*d* of the transform window 364 typically comprises the same temporal position and characteristics as the right-sided transition portions 324*c* of the transform window 324 and 348*b* of the subwindow 348. In addition, the transform window 364 comprises a right-sided zero portion 364*e*, which is preferably identical in its temporal position and characteristics with the right-sided zero portions 324*d*, 340*b* of the transform windows 324, 340.

The transform window 364 is adapted for a transform of an audio content of an audio frame, which is inserted between a previous audio frame, which is encoded in the frequency-domain and the MDCT-coefficients of which are generated using the transform window 330 (i.e. a high-temporal resolution transform window), and a subsequent audio frame encoded in the linear-prediction-domain. For this purpose, the left-sided transition slope 364*b* of the transform window 364 is matched to the right-sided transition slope 338*b* of the sub-window 338 of the transform window 330, to allow for an aliasing cancellation when overlapping-and-adding time-domain representations of subsequent audio frames generated (e.g. in the audio decoder 200) using the transform windows 330, 364. In addition, the right-sided transition slope 364*d* of the transform window 364 is adapted such that an overlap-and-add transition can be performed without applying an explicit aliasing cancellation functionality.

In the following, the "normal" window shape version 370 of window type "stop_window_1152" will be described. It should be noted here that the transform window 370 comprises a total duration of 2304 time-domain samples, and that 1152 MDCT-coefficients are associated with an audio frame encoded using the transform window 370. The transform window 370 comprises a left-sided zero portion 370*a* of temporal duration 512 time-domain samples. Also, the transform window 370 comprises a left-sided transition slope 370*b* of temporal duration 128 time-domain samples, which is arranged such that the transition slope 370*b* extends in both a left-sided half and a right-sided half of the left-sided portion of the transform window 370. In addition, the transform window 370 comprises a constant (non-zero) central portion of temporal duration 576 time-domain samples. Further, the transform window 370 comprises a right-sided transition slope 370*d* of temporal duration 1024 time-domain samples and a right-sided zero portion 370*e* of temporal duration 64 time-domain samples. The transform window 370 is adapted for an encoding/decoding of a current audio frame inserted between a previous audio frame encoded in the linear-prediction-domain and a subsequent audio frame encoded in the frequency-domain using a low temporal resolution (for example using a transform window 310 or a transform window 320).

In the following, "normal" window shaped version 380 of window type "stop_start_window_1152" will be described. 1152 MDCT coefficients are typically associated with an audio frame of 2304 time domain samples encoded using the window shape 380. The transform window 380 comprises a left-sided zero portion 380*a*, which is identical in its temporal position and characteristics to the left-sided zero portion 370*a* of the transform window 370, and a left-sided transition slope 380*b*, which is identical in its temporal position and characteristics to the left-sided transition slope 370*b* of the transform window 370. The transform window 380 also comprises a constant central portion 380*c* of temporal duration 1024 time-domain samples. In addition, the transform window 380 comprises a right-sided transition slope 380*d*, which is similar in its position and characteristics to the right-sided transition slope 360*d* of the transform window 360. The transform window 380 also comprises a right-sided zero portion 380*e* of temporal duration 512 time-domain samples. The transform window 380 is adapted to be used for an encoding or decoding of an audio frame, which is embedded between a previous audio frame encoded in the linear-prediction-domain and a subsequent audio frame encoded using a high temporal resolution (for example using the transform window 330).

In the following, the "modified" window shape version 384 of the window type "stop_start_window_1152" will be described. Typically, 1152 MDCT coefficients are associated to an audio frame encoded using the window type 384. The transform window 384 comprises a left-sided zero portion 384*a*, which is identical to the left-sided zero portion 380*a* of the transform window 380, and also a left-sided transition slope 384*b*, which is identical to the left-sided transition slope 380*b* of the transform window 380. The transform window 384 also comprises a central (non-zero) constant portion 384*c*, which is identical to the central constant portion 380*c* of the transform window 380. However, a right-sided transition slope 384*d* of the transform window 384 is temporally shortened in comparison to the right-sided transition slope 380*d* of the transform window 380. For example, the right-sided transition slope 384*d* may be very similar (or even identical) in its position and characteristics to the right-sided transition slopes 364*d*, 348*d* of the transform window 364 or the subwindow 348 of the transform window 340 (taking into consideration that the temporal duration of the transform window 384 is 2304 time-domain samples, rather than 2048 time-domain samples). Thus, the transition slope 384*d* may comprise a temporal duration of 64 time-domain samples, and may be included entirely in the left-sided half of the right-sided portion of the transform window 384, thereby avoiding aliasing. The transform window 384 also comprises a right-sided zero portion of temporal duration 576 time-domain samples. The transform window 384 is adapted to be used for an encoding or decoding of an audio frame, which is embedded between a preceding linear-prediction-domain-encoded audio frame and a subsequent linear-prediction-domain-encoded audio frame. Accordingly, the left-sided transition slope 384*b* of the transform window is adapted for an aliasing-cancelling cross-fade between a time-domain representation of a previous audio frame encoded in the linear prediction domain and a time domain representation of the current audio frame. In particular, a temporal position of the transition slope 384*b* is adapted, such that the transition slope 384*b* is offset to the left by approximately 128 time domain samples relative to a center between two adjacent frame boundaries (shown by thin solid vertical lines). In addition, the right-sided transition slope 384*d* of the transform window 384 is adapted such that an overlap-and-add transition can be performed without applying an explicit aliasing cancellation functionality.

3.2. Window Type "Long_Start_Window_to_LPD"

In the following, more details regarding some particularly important window types will be described taking reference to FIGS. 4*a*-4*d*.

In the following, some details regarding the application of the "modified" window shape version of window type "long_start_window", which is also designated by reference numeral 324, and by the name "long_start_window_to_LPD" will be discussed taking reference to FIG. 2*a*.

First of all, it should be noted that the transform window 324 is adapted to be applied in an audio decoder for the provision of a time-domain representation of an audio frame, which is embedded between a previous audio frame encoded in the frequency domain and a subsequent audio frame encoded in the linear-prediction-domain. A portion of the time-domain representation of the current audio frame, to which the left-sided transition slope 324*a* is applied, is typically overlapped-and-added with a time-domain representation of a previous frequency-domain-encoded audio frame, to which a right-sided transition slope of an appropriate transform window (for example of the transform window 310 or of the transform window 350 or of the transform window 370) is applied. Accordingly, an aliasing cancellation is obtained due to the match of the transition slopes. In contrast, a portion of the time-domain representation of the current audio frame, to which the transition slope 324*c* is applied, is overlapped-and-added with a windowed (but not time-domain-aliasing-processed) version of a time-domain representation of the subsequent linear-prediction-domain-encoded audio frame. Accordingly, smoothened transitions between the time-domain representations of the previous audio frame and of the current audio frame and between the time-domain representations of the current audio and the subsequent audio frame are obtained.

3.3. Window Type "8*Short_Window_to_LPD"

Figure 4A:
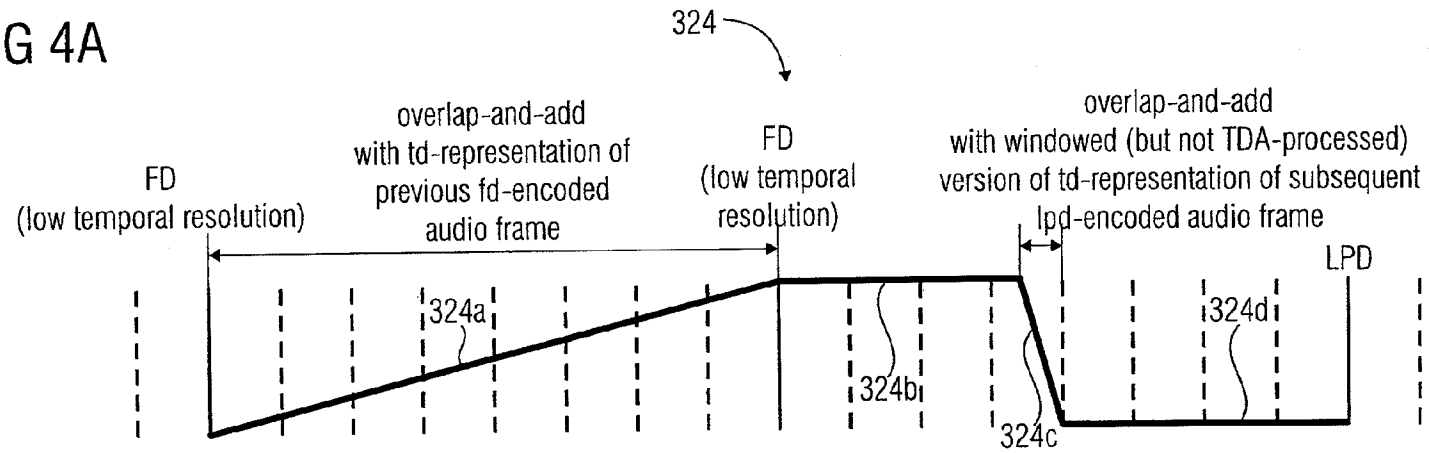
FIG. 4*a* shows a detailed schematic representation of a transform window of type "long_start_window_to_LPD"
Figure 4B:
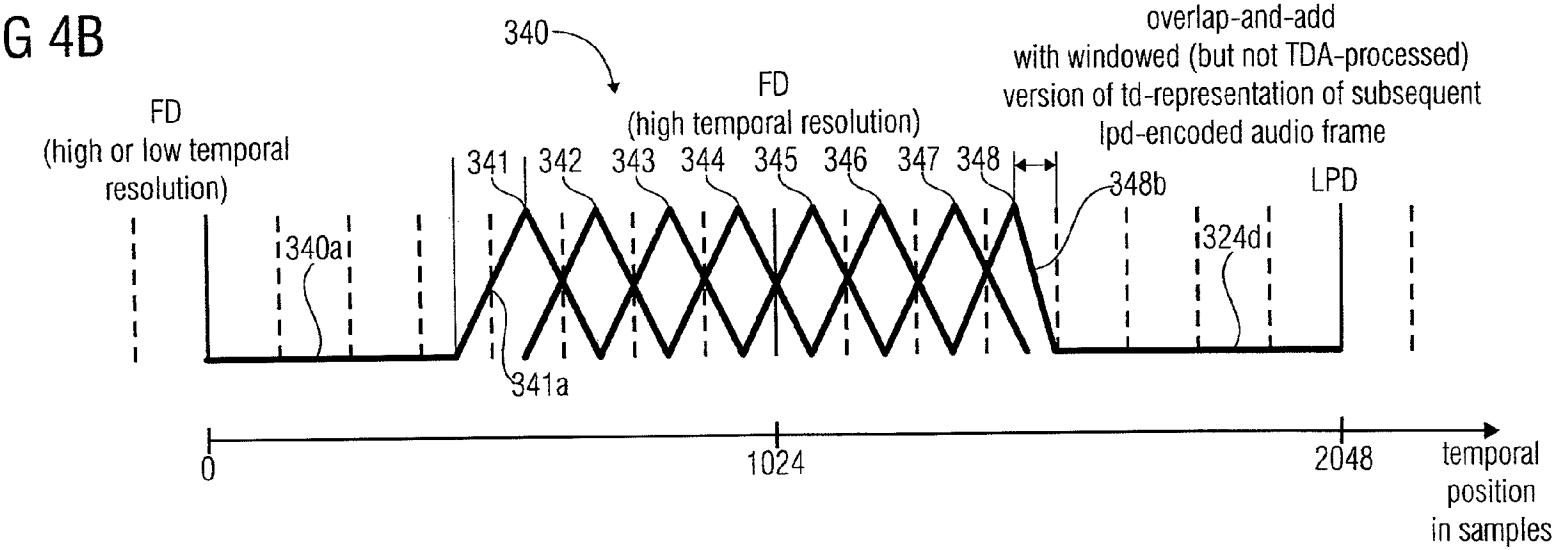
FIG. 4*b* shows a detailed schematic representation of a transform window of type "8*short_window_to_LPD"

In the following, some details regarding the application of the "modified" window shape version 340 of the window type "8*short_window" will be described taking reference to FIG. 4*b*. As can be seen in FIG. 4*b*, the transform window 340 is adapted for an application in an audio decoder, wherein the "modified" transform window 340 (which is also sometimes designated as "8*short_window_to_LPD") is adapted for a provision of a time domain representation of a current frequency-domain-encoded audio frame, which current frequency-domain-encoded audio frame is encoded with comparatively high temporal resolution, and which current frequency-domain-encoded audio frame is adapted to be embedded between a previous frequency-domain-encoded audio frame and a subsequent linear-prediction-domain-encoded audio frame. Preferably, the time-domain representation of the previous frequency-domain-encoded audio frame is obtained using a transform window 320, a transform window 360 or a transform window 380 (if the previous audio frame is encoded using a comparatively lower temporal resolution) or using a transform window 330 (if the previous audio frame is encoded using a comparatively higher temporal resolution). A portion of the time-domain representation of the current audio frame, to which the transition slope 341*a* is applied, is overlapped-and-added in the audio decoder 200 with a portion of the a time-domain representation of the previous audio frame, to which one of the transition slopes 320*c*, 360*b*, 380*b* or 338*b* is applied. Accordingly, a transition between the time-domain representation of the previous audio frame and the time-domain representation of the current audio frame is smoothened, and an aliasing cancellation is performed. A temporal portion of the time-domain representation of the current audio frame, to which the transition slope 348*b* is applied, is overlapped-and-added with a windowed (but not time-domain-aliasing-processed) version of a time-domain representation of the subsequent linear-prediction-domain-encoded audio frame. Accordingly, a transition between the current, linear-prediction-domain-encoded audio frame, which comprises a comparatively high temporal resolution, and the subsequent linear-prediction-domain-encoded audio frame is smoothened.

3.4. Window Type "Stop_Start_Window_to_LPD"

Figure 4C:
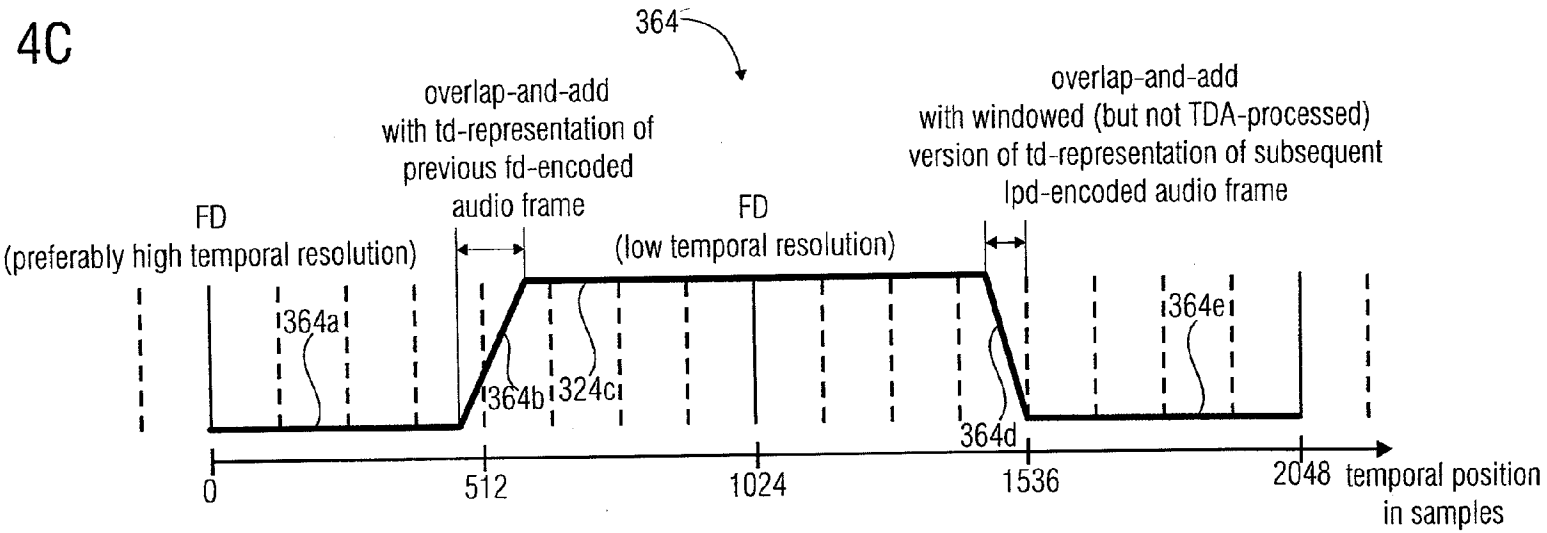
FIG. 4*c* shows a detailed schematic representation of a transform window of type "stop_start_window_to_LPD"
Figure 4D:
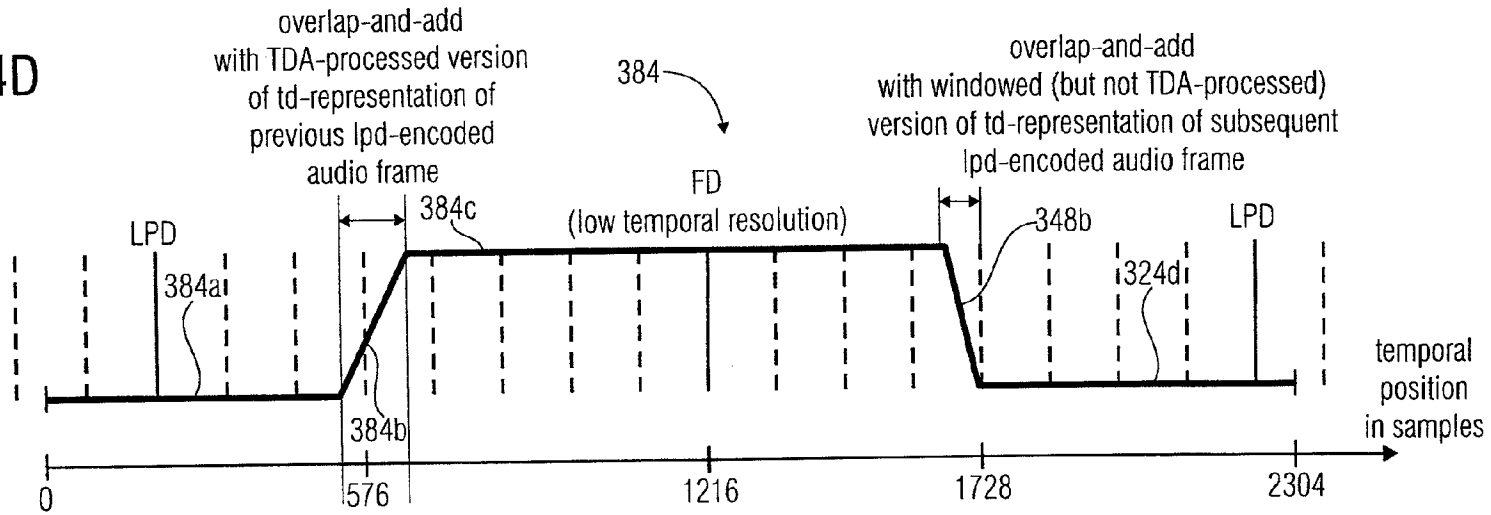
FIG. 4*d* shows a detailed schematic representation of a transform window of type "stop_start_window_1152_to_LPD"

In the following, the application of the "modified" window shape version 364 of the window type "stop_start_window", which is also sometimes designated as "stop_start_window_to_LPD", will be described with reference to FIG. 4*c*.

The transform window 364 is applied by an audio decoder for providing a time-domain representation of an audio frame encoded with comparatively low temporal resolution, which current audio frame is embedded between a previous audio frame encoded in the frequency-domain, preferably using a comparatively higher temporal resolution, and a subsequent audio frame encoded in the linear-prediction-domain. For example, the previous audio frame may be obtained using a "normal" window shape version 330 of window type "8*short_window". However, in some cases, the previous audio frame may be encoded using a "normal" window shape version 320, 360 or 380 of window type "long_start_window", "stop_start_window" or "stop_start_window__1152". In an audio decoder, an overlap-and-add operation may be performed between time-domain samples of the current audio frame, to which the left-sided transition slope 364*b* of the transform window 364 is applied, and time-domain samples of a time-domain representation of the previous, frequency-domain-encoded audio frame, to which a transition slope 338*b* of the transform window 330 (or, alternatively, a transition slope 320*c* of the transform window 320, a transition slope 360*b* of the transform window 360 or a transition slope 380*b* of the transform window 380) has been applied. Accordingly, a transition between the time-domain representation of the previous audio frame and the time-domain representation of the current audio frame is smoothened. In addition, an overlap-and-add is performed in an audio decoder between time-domain samples of a time-domain representation of the current audio frame, to which the transition slope 364*d* of the transform window 364 has been applied, and time-domain samples of a time-domain representation of the subsequent linear-prediction-domain-encoded audio frame (wherein a matched transition window may be applied to the time-domain samples of the subsequent linear-prediction-domain-encoded audio frame before the overlap-and-add operation). Accordingly, a transition between the time-domain representation of the current audio frame and the time-domain representation of the subsequent audio frame may be smoothened without having the need to implement an aliasing cancellation mechanism at this transition.

3.5. Window Type "Stop_Start_Window__1152__2_LPD"

In the following, the application of the "modified" window shape version 384 of the window type "stop_start_window__1152" in an audio decoder will be described. The transform window 384 is used in an audio decoder for obtaining a time-domain representation of an audio frame of comparatively low temporal resolution, which is embedded between a previous audio frame encoded in the linear-prediction-domain and a subsequent audio frame also encoded in the linear-prediction-domain. Thus, the transform window 384 allows the insertion of a single frequency-domain-encoded audio frame between two linear-prediction-domain-encoded audio frames.

The audio decoder 200 is preferably configured to perform an overlap-and-add operation between time-domain samples of the time-domain representation of the current audio frame to which time-domain samples the transition slope 384*b* is applied and time-domain samples of a time-domain representation of the previous linear-prediction-domain-encoded audio frame. Before performing the overlap-and-add operation, a time-domain-aliasing processing may be applied to the time-domain representation of the previous linear-prediction-domain-encoded audio frame, which time-domain-aliasing processing may include the insertion of time-domain aliasing components and the application of a window slope to time domain samples in the temporal overlap region. Accordingly, a smoothened transition between the previous linear-prediction-domain-encoded audio frame and the current frequency-domain-encoded audio frame is obtained. Moreover, an overlap-and-add operation may be performed by the audio decoder 200 between a temporal portion of the time-domain representation of the current audio frame, to which temporal portion the transition slope 384*d* is applied, and time-domain samples of a time-domain representation of the subsequent linear-prediction-domain-encoded audio frame (wherein a windowing may be applied to the time-domain representation of the linear-prediction-domain-encoded audio frame before the execution of the overlap-and-add operation). Accordingly, a smoothened transition between the time-domain representation of the current frequency-domain-encoded audio frame and the time-domain representation of the subsequent linear-prediction-domain-encoded audio frame can be obtained.

3.6. Allowed Window Sequences—Overview

In the following, an overview will be given of window sequences (in the sense of sequences of window types 310, 320, 324, 330, 340, 350, 360, 364, 370, 380, 384), which are allowed in an audio encoder 100 or an audio decoder 200 according to the present invention. Nevertheless, it should be noted that it is not required to implement all of the transform windows described with respect to FIGS. 3 and 4*a*-4*d* and all of the window sequences described with reference to FIG. 5 in an audio encoder or audio decoder according to the present invention.

FIG. 5 shows a schematic representation of allowed transitions between audio frames encoded using different window types, and even between audio frames encoded in different domains. It should be noted that the terms "only_long_sequence", "long_start_sequence", "eight_short_sequence", "long_stop_sequence", "stop_start_sequence", "stop__1152_sequence" and "stop_start__1152_sequence" are used in FIG. 5, which are equivalent to the window types "long_window", "long_start_window", "8*short_window", "long_stop_window", "stop_start_window", "stop_window__1152" and "stop_start_window__1152", as can be seen in FIG. 3. In addition, it should be noted that the term "LPD_sequence" designates an audio frame encoded in the linear-prediction-domain. Moreover, it should be noted that a "normal" window shape 310, 320, 330, 350, 360, 370, 380 is used for the encoding or decoding of a current audio frame, if the current audio frame is followed by a subsequent audio frame encoded in the frequency-domain, and that a "modified" window shape 324, 348, 364, 384 is used for the encoding or decoding of the current audio frame, if the current audio frame is followed by a subsequent audio frame encoded in the linear-prediction-domain.

As can be seen in FIG. 5, an audio frame encoded using the window type "long_window" can be followed by an audio frame encoded using the window type "long_window" or "long_start_window": An audio frame encoded using the window type "long_start_window" can be followed by an audio frame encoded using the window type "8*short_window", "long_stop_window" or "stop_start_window". However, the audio frame encoded using the window type "long_start_window" can also be followed by an audio frame encoded in the linear-prediction-domain, by using the "modified" window shape 324.

An audio frame encoded using window type "8*short_window" can be followed by an audio frame encoded using the window type "8*short_window", "long_stop_window" or "stop_start_window". However, by using the transform window 340, an audio frame encoded using the window type "8*short_window" may also be followed by an audio frame encoded in the linear-prediction-domain.

An audio frame encoded using the window type "long_stop_window" may be followed by an audio frame encoded using the window type "long_window" or "long_start_window".

An audio frame encoded using the window type "stop_start_window" may be followed by an audio frame encoded using the window type "8*short_window", "long_stop_window" or "stop_start_window". However, the audio frame encoded using the window type "stop_start_window" may also be followed by an audio frame encoded in the linear-prediction-domain using the "modified" transform window 364.

An audio frame encoded using the window type "stop_window_1152" may be followed by a subsequent audio frame encoded using the window type "long_window" or "long_start_window".

An audio frame encoded using the window type "stop_start_window_1152" may be followed by a subsequent audio frame encoded using a window type "8*short_window", "long_stop_window" or "stop_start_window". However, an audio frame encoded using the window type "stop_start_window_1152" may also be followed by an audio frame encoded in the linear-prediction-domain by using the "modified" transform window 384.

A current audio frame encoded in the linear-prediction-domain may be followed by a subsequent audio frame encoded in the linear-prediction-domain or by a frequency-domain-encoded audio frame encoded using the window type "stop_window_1152" or "stop_start_window_1152".

In the following, some possible sequences of audio frames will be described in more detail.

3.7. Transition from Low-Temporal-Resolution-Frequency-Domain-Encoded Audio Frame to a Linear-Prediction-Domain-Encoded Audio Frame In the following, a sequence of transform windows will be described which involves performing an indirect (with an intermediate frame in between) transition from a frequency-domain-encoded audio frame to a linear-prediction-domain-encoded audio frame. It should be noted, that in the following discussions, the frames designated by subsequent frame numbers in order to be able to identify the frames.

Taking reference now to FIG. 6*a*, which shows a schematic representation of a first sequence of transform windows, a case will be described in which an audio frame encoded in the linear-prediction-domain follows a plurality of audio frames encoded in the frequency-domain with comparatively low temporal resolution. As can be seen, a first audio frame 610 is encoded in the frequency-domain using a comparatively low temporal resolution and using the transform window 310. A second, subsequent audio frame 620, which is temporally overlapping (for example by 50%) with the first audio frame 610, is encoded in the frequency-domain using the transform window 324. An overlap-and-add is performed (in an audio decoder 200) between time-domain representations of the audio contents of the first and second audio frame 610, 620 in the temporal overlap region. A third audio frame 630, which is temporally overlapping with the second audio frame 620 (for example by 50%) is encoded in the linear-prediction-domain. An overlap-and-add operation is performed between the time-domain representation of the second audio frame 620 and the time-domain representation of the audio content of the third audio frame 630 (represented by linear-prediction-domain parameters). For this purpose, a transition slope windowing (represented at reference numeral 630*a*) is applied to a time-domain representation of the audio content of the third audio frame 630. The third audio frame 630 is followed by a fourth audio frame 640, which may be encoded in the frequency-domain (as shown in FIG. 6*a*) or in the linear-prediction-domain.

Figure 6A:
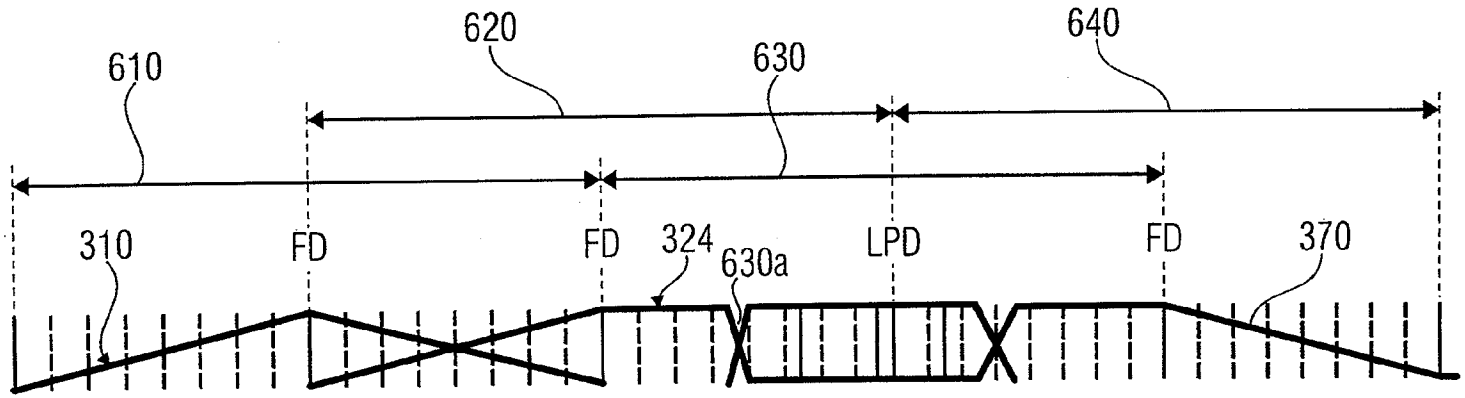
FIG. 6*a* shows a schematic representation of a first window sequence.

The sequence of encoded audio frames shown in FIG. 6*a* is useful in a situation in which there are no step transitions closely preceding (within the previous one or two frames) a speech-like audio frame encoded in the linear-prediction-domain.

However, sequences of transform windows, which are better suited if a speech-like audio frame follows a significant transient (e.g. step transition) of the audio content will be described with reference to FIGS. 6*b* and 6*d*.

3.8. Direct Transition from High-Temporal-Resolution-Frequency-Domain-Encoded Audio Frame to a Linear-Prediction-Domain-Encoded Audio Frame FIG. 6*b* shows a schematic representation of a sequence of transform windows, which brings along an improved coding efficiency and audio quality if there is a significant transient in the audio content of an audio frame (directly) preceding a speech-like audio frame. It has been found that this situation is relatively frequent, because the onset of a speech-like audio portion often follows an abrupt stop of background sounds, like background noise or instrumental music. As can be seen in FIG. 6*b*, a first audio frame 650 may, for example, be encoded in the frequency-domain using a low temporal resolution (as shown in FIG. 6*b*) or a high temporal resolution (not shown). A second, subsequent audio frame 652 is encoded in the frequency-domain using a comparatively high temporal resolution. The second audio frame 652 is encoded using the transform window 340, which has been described before. The high-temporal resolution of the second audio frame 652 is obtained by using a plurality of sub-windows 341-348, to which separate (short) sets of MDCT-coefficients (e.g. 128 MDCT coefficients per sub-window) are associated. Importantly, a transition slope of the transform window is adapted to provide for a smoothened transition to a third audio frame 654, which is encoded in the linear-prediction-domain. As can be seen, an overlap-and-add operation is performed, in an audio decoder, between time-domain representations of an audio content of the second audio frame 652 (which is decoded using the transform window 340) and the time-domain representation of an audio content of the third audio frame 654. A windowing is applied to the time-domain representation of the audio content of the third audio frame 654, which is indicated at reference number 654*a*. The third audio frame 654 is followed by a fourth audio frame 656, which may be encoded in the linear-prediction-domain, or which may be encoded in the frequency-domain (for example using the transform window 370, the transform window 380 or the transform window 384).

Figure 6B:
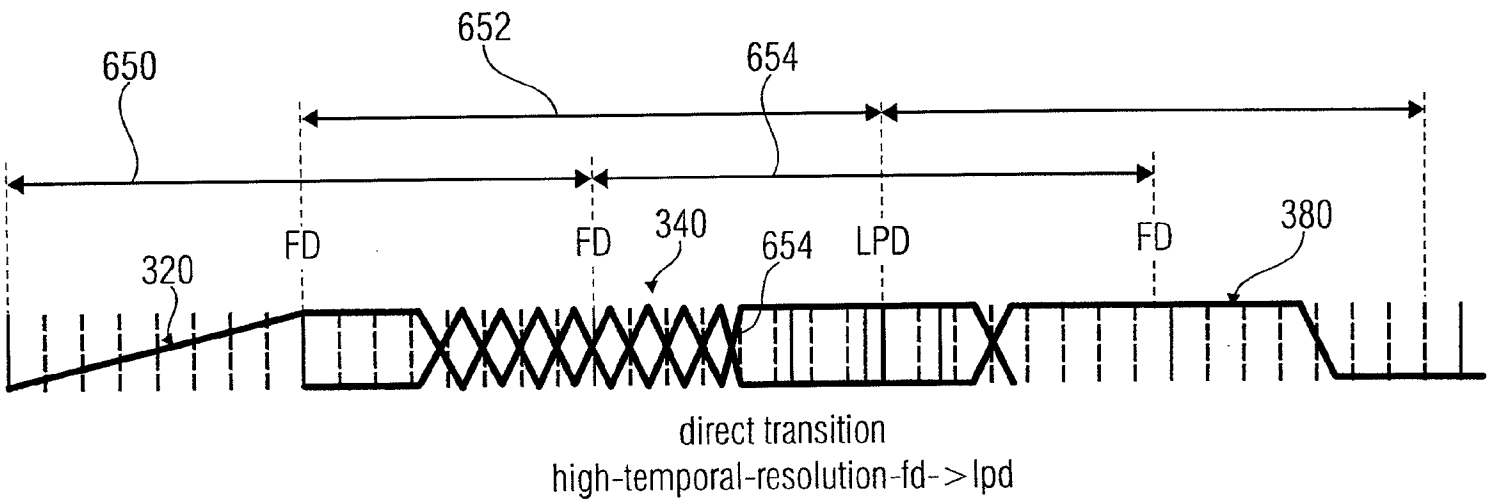
FIG. 6*b* shows a schematic representation of a second window sequence.

To summarize, the sequence of transform windows of FIG. 6*b*, which comprises the "modified" window shape transform window 340 of type "8*short_window" allows for a direct transition between the second audio frame 652, which is encoded in the frequency-domain using a comparatively high-temporal resolution, and the third audio frame 654 encoded in the linear-prediction-domain.

Figure 6C:
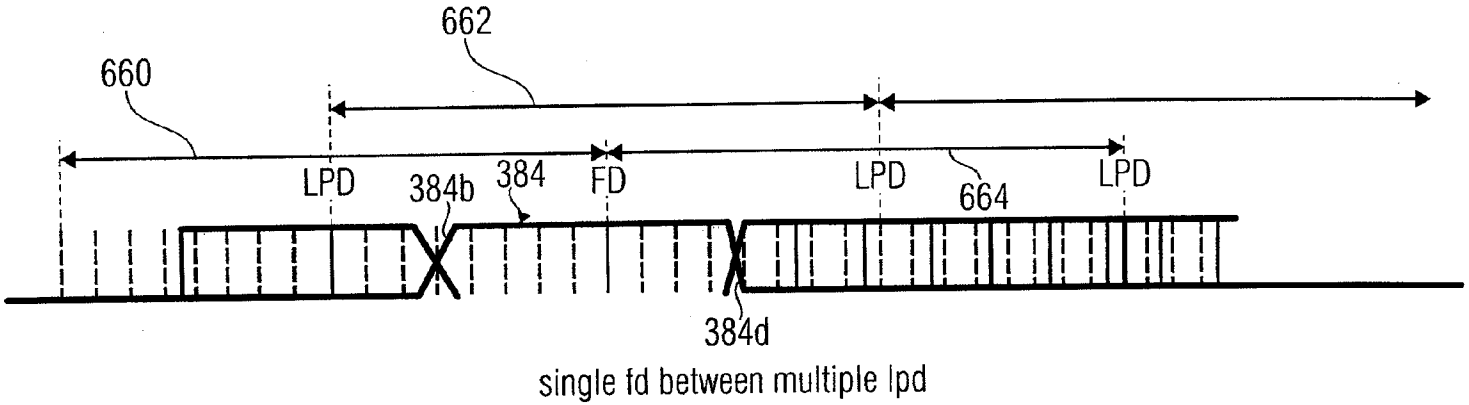
FIG. 6*c* shows a schematic representation of a third window sequence.

3.9. Single Frequency-Domain-Encoded Audio Frame Between Linear-Prediction-Domain-Encoded Audio Frames In the following, another important sequence of transform windows will be described with reference to FIG. 6*c*, which shows a graphical representation of such a sequence of transform windows. As can be seen in FIG. 6*c*, a first audio frame 660 is encoded in the linear-prediction-domain. A second audio frame 662 is encoded in the frequency-domain, wherein the transform window 384 is used for encoding and decoding the second audio frame 662. The second audio frame 662 is followed by a third audio frame 664, which is encoded in the linear-prediction-domain. As can be seen, the left-sided transition slope 384*b* of the transform window 384 (which is used for encoding and decoding the second audio frame 662) is adapted for performing an aliasing-canceling overlap-and-add operation between the time-domain representation of the audio content of the first audio frame 660 and the time-domain representation of the audio content of the second audio frame 662. In order to allow for such an aliasing-canceling overlap-and-add operation, and increased number of MDCT-coefficients (e.g. 1152 MDCT-coefficients) is associated with the second audio frame 662 (when compared to, for example, 1024 MDCT-coefficients associated with frequency-domain-encoded audio frames embedded between two adjacent frequency-domain-encoded audio frames). Accordingly, an aliasing-canceling overlap-and-add is performed between the time-domain representations to the audio content of the first and second audio frames 660, 662, wherein time-domain-aliasing processing and a windowing is applied to the audio content of the first audio frame 660. A third audio frame 664 is encoded in the linear-prediction-domain, and an overlap-and-add operation is performed in an audio decoder 200 between the time-domain representations of the second audio frame 662 and of the third audio frame 664. For this purpose, the transition slope 384*d* of the transform window 380 is exploited. Also, a windowing is applied to the time-domain representation of the third audio frame 664.

The window sequence of FIG. 6*c* allows for the insertion of a single frequency-domain-encoded audio frame between neighboring linear-prediction-domain-encoded audio frames, wherein an appropriate overlap-and-add can be performed both at the transition from the first audio frame 660 to the second audio frame 662 and at the transition from the second audio frame 662 to the third audio frame 664. Specifically, the transition slopes of the transform window 380 are adapted such that a bitrate-efficient overlap-and-add with aliasing cancellation is performed between the first audio frame 660 and the second audio frame 662, and such that a computationally efficient and low distortion overlap-and-add without the need for an aliasing cancellation can be performed at the transition from the second audio frame 662 to the third audio frame 664. This is achieved by using transition slopes 384*b*, 384*d* of different temporal duration and by associating an increased number of MDCT-coefficients to the second audio frame 662 (1152 MDCT-coefficients instead of 1024 MDCT-coefficients). Accordingly, it is possible to encode stationary background noise in the breaks (or pauses) between two speech-like audio frames with good bitrate efficiency while maintaining the possibility of obtaining smooth transitions in an audio decoder.

3.10. Transition from High-Temporal-Resolution-Frequency-Domain-Encoded Audio frame to a Linear-Prediction-Domain-Encoded Audio Frame via a Frequency-Domain-Encoded "Interposer" Audio Frame In the following, another advantageous sequence of transform windows will be described taking reference to FIG. 6*d*, which shows a schematic representation of such a sequence of transform windows. A first audio frame 670 is encoded in the frequency-domain, for example using a comparatively low temporal resolution. For example, the transform window 320 may be applied for the encoding and the decoding the first audio frame 670. A second audio frame 672 is encoded in the frequency-domain using a comparatively high-temporal resolution. For example, a transform window 330 is used for the encoding and decoding of the second audio frame 672. A third audio frame 674 is encoded in the frequency-domain using a comparatively lower temporal resolution. However, rather than using the transform window 360, the "modified" transform window 364 is used for encoding and decoding the third audio frame 674. Accordingly, matched transition slopes 338*b*, 364*b* are provided at the transition from the second audio frame 672 to the third audio frame 674, such that an aliasing-canceling overlap-and-add can be performed there. A fourth audio frame 676 is encoded in the linear-prediction-domain. However, a transition slope 364*d* of the transform window 364 is adapted for performing an overlap-and-add operation with the fourth audio frame 676 without requiring an aliasing-cancellation.

Figure 6D:
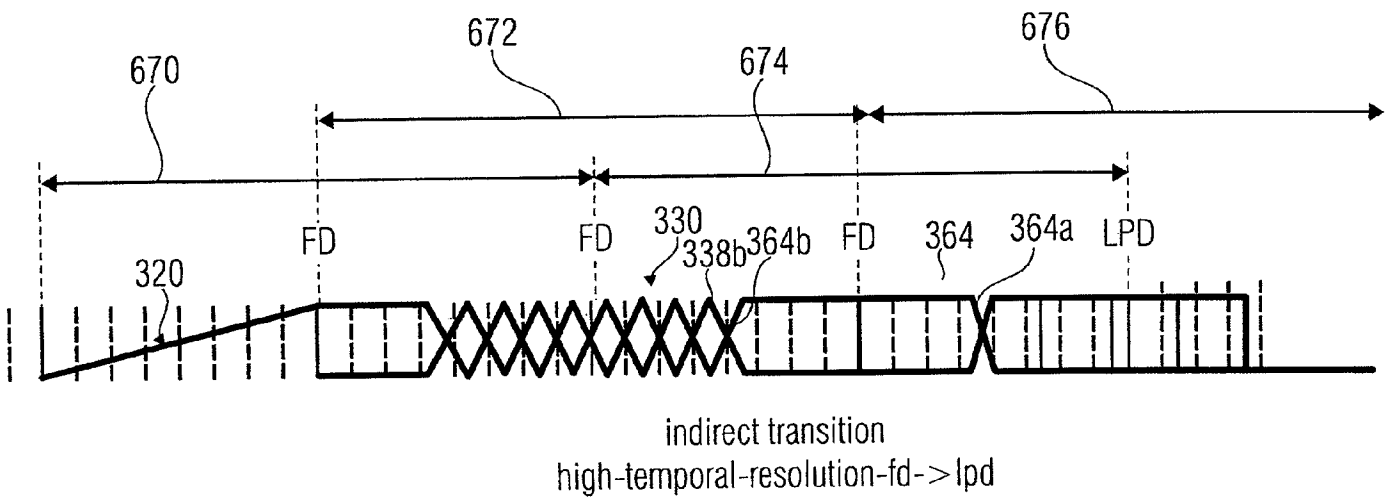
FIG. 6*d* shows a schematic representation of a fourth window sequence.

The window sequence of FIG. 6*d* allows for an indirect transition (with the third audio frame 674 in between) between a high-temporal-resolution-frequency-domain-encoded audio frame 672 and a linear-prediction-domain-encoded audio frame 676, wherein a low-temporal-resolution-frequency-domain-encoded audio frame 674 is in between the audio frames 672, 676. Such a window sequence is for example advantageous if a transient event in an audio signal, for example a fast reduction of the volume of a background noise, is spaced from a speech-like audio frame 676 by one intermediate non-speech audio frame 674, in which the background noise is approximately stationary. While the usage of the transform window 324 would not allow for a bitrate-efficient audio coding, which represents the transient event with good audio quality, the usage of the transform window 364 at the encoder and at the decoder allows for a very good tradeoff between bitrate and audio quality in such cases.

4. Decoder Implementation Details

In the following, some details regarding the functionality of the frequency-domain decoder core 250 of the audio decoder 200 will be described. Also, some details of the overlap-and-add processor 270 will be described. These functionalities are sometimes also designated as "filterbank and block switching".

4.1. Tool Description

The time/frequency representation 242 of the signal is mapped onto the time domain by feeding it into the filterbank module 250*a*. This module consists of an inverse modified discrete cosine transform (IMDCT), and a window and an overlap-add function. In order to adapt the time/frequency resolution of the filterbank to the characteristics of the input signal, a block switching tool is also adopted. N represents the window length, where N is a function of the window_sequence.

Depending on the signal, the coder may change the time/frequency resolution by using three different windows size: 2304, 2048 and 256. To switch between windows, the transition windows LONG_START_WINDOW, LONG_STOP_WINDOW, STOP_WINDOW_1152, STOP_START_WINDOW and STOP_START_WINDOW_1152 are used. FIG. 3 lists the windows, specifies the corresponding transform length and shows the shape of the windows schematically. Three transform lengths are used: 1152, 1024 (or 960) (referred to as long transform) and 128 (or 120) coefficients (referred to as short transform).

Window sequences are composed of windows in a way that a raw_data_block always contains data representing 1024 (or 960) output samples. The data element window_sequence indicates the window sequence that is actually used. FIG. 3 lists how the window sequences (also designated as "transform windows") are composed of individual windows (also designated as "sub-windows").

For each channel, the N/2 time-frequency values $X_{i,k}$ are transformed into the N time domain values $x_{i,n}$ via the IMDCT. After applying the window function, for each channel, the first half of $z_{i,n}$ the sequence is added to the second half of the previous block windowed sequence $z_{(i-1),n}$ to reconstruct the output samples for each channel $out_{i,n}$.

4.2. Definitions window_sequence 2 bit indicating which window sequence (i.e. block size) is used.

window_shape 1 bit indicating which window function is selected.

FIG. 3 shows the eleven window_sequences based on the seven transform windows.

(ONLY_LONG_SEQUENCE, LONG_START_SEQUENCE, EIGHT_SHORT_SEQUENCE, LONG_STOP_SEQUENCE, STOP_START__1152_SEQUENCE, STOP__1152_SEQUENCE, STOP_START__1152_SEQUENCE).

In the following LPD_SEQUENCE refers to all allowed window/coding mode combinations inside the so called linear prediction domain codec. In the context of decoding a frequency domain coded frame it is important to know only if a following frame is encoded with the LP domain coding modes, which is represented by an LPD_SEQUENCE. However, the exact structure within the LPD_SEQUENCE is taken care of when decoding the LP domain coded frame.

4.3. Decoding Process

4.3.1. IMDCT (Inverse-Modified-Discrete-Cosine-Transform)

The analytical expression of the IMDCT is:

$$x_{i,n} = \frac{2}{N}\sum_{k=0}^{\frac{N}{2}-1} \mathrm{spec}[i][k]\cos\left(\frac{2\pi}{N}(n+n_0)\left(k+\frac{1}{2}\right)\right) \text{ for } 0 \le n < N$$

where:

n=sample index i=window index k=spectral coefficient index

N=window length based on the window_sequence value $n_0=(N/2+1)/2$

The synthesis window length N for the inverse transform is a function of the syntax element window_sequence and the algorithmic context. It is defined as follows:

Window Length 2304:

$$N = \begin{cases} 2048, & \text{if ONLY_LONG_SEQUENCE} \\ 2048, & \text{if LONG_START_SEQUENCE} \\ 256, & \text{if EIGHT_SHORT_SEQUENCE} \\ 2048, & \text{If LONG_STOP_SEQUENCE} \\ 2048, & \text{If STOP_START_SEQUENCE} \end{cases}$$

Window length 2048:

$$N = \begin{cases} 2304, & \text{if STOP_1152_SEQUENCE} \\ 2304, & \text{if STOP_START_1152_SEQUENCE} \end{cases}$$

The meaningful block transitions are listed in the table of FIG. 5. A tick mark ((☑) ) in a given table cell indicates that a window sequence listed in that particular row may be followed by a window sequence listed in that particular column.

4.3.2. Windowing and Block Switching

Depending on the window_sequence and window_shape element different transform windows are used. A combination of the window halves described as follows offers all possible window_sequences. The window shape describes the shape of the so-called transition slopes.

For window_shape==1, the window coefficients are given by the Kaiser-Bessel derived (KBD) window as follows:

$$W_{KBD_LEFT,N}(n) = \sqrt{\frac{\sum_{p=0}^{n}[W'(p,\alpha)]}{\sum_{p=0}^{N/2}[W'(p,\alpha)]}} \quad \text{for } 0 \le n < \frac{N}{2}$$

$$W_{KBD_RIGHT,N}(n) = \sqrt{\frac{\sum_{p=0}^{N-n-1}[W'(p,\alpha)]}{\sum_{p=0}^{N/2}[W'(p,\alpha)]}} \quad \text{for } \frac{N}{2} \le n < N$$

where:

W', Kaiser-Bessel kernel window function, is defined as follows:

$$W'(n,\alpha) = \frac{I_0\left[\pi\alpha\sqrt{1.0-\left(\frac{n-N/4}{N/4}\right)^2}\right]}{I_0[\pi\alpha]} \quad \text{for } 0 \le n < \frac{N}{2}$$

$$I_0[x] = \sum_{k=0}^{\infty}\left[\frac{\left(\frac{x}{2}\right)^k}{k!}\right]^2$$

$\alpha$ = kernel window alpha factor, $$\alpha = \begin{cases} 4 \text{ for } N = 2048\ (1920) \\ 6 \text{ for } N = 256\ (240) \end{cases}$$

Otherwise, for window_shape==0, a sine window is employed as follows:

$$W_{SIN_LEFT,N}(n) = \sin\left(\frac{\pi}{N}\left(n+\frac{1}{2}\right)\right) \quad \text{for } 0 \le n < \frac{N}{2}$$

$$W_{SIN_RIGHT,N}(n) = \sin\left(\frac{\pi}{N}\left(n+\frac{1}{2}\right)\right) \quad \text{for } \frac{N}{2} \le n < N$$

The window length N can be 2048 (1920) or 256 (240) for the KBD and the sine window. In case of STOP__1152_SEQUENCE and STOP_START__1152_SEQUENCE, N can still be 2048 or 256, the window slopes (or transition slopes) are similar but the flat top regions are longer.

How to obtain the possible window sequences is explained in the parts a)-g) of this subclause.

For all kinds of window_sequences the window_shape of the left half of the first transform window is determined by the window shape of the previous block (or audio frame). The following formula expresses this fact:

$$W_{LEFT,N}(n) = \begin{cases} W_{KBD_LEFT,N}(n), \text{ if window_shape_previous_block} = 1 \\ W_{SIN_LEFT,N}(n), \text{ if window_shape_previous_block} = 0 \end{cases}$$

where:

window_shape_previous_block: window_shape of the previous block or audio frame (i-1).

For the first raw_data_block( )(or audio frame) to be decoded the window_shape of the left and right half of the window are identical.

In case the previous block or audio frame was coded using LPD mode, window_shape_previous_block is set to 0.

a) ONLY_LONG_SEQUENCE:

The window_sequence==ONLY_LONG_SEQUENCE is equal to one LONG_WINDOW with a total window length N_l of 2048 (1920).

For window_shape==1, the window for ONLY_LONG_SEQUENCE is given as follows:

$$W(n) = \begin{cases} W_{LEFT,N_l}(n), & \text{for } 0 \le n < \text{N_l}/2 \\ W_{KBD_RIGHT,N_l}(n), & \text{for } \text{N_l}/2 \le n < \text{N_l} \end{cases}$$

If window_shape==0, the window for ONLY_LONG_SEQUENCE can be described as follows:

$$W(n) = \begin{cases} W_{LEFT,N_l}(n), & \text{for } 0 \le n < \text{N_l}/2 \\ W_{SIN_RIGHT,N_l}(n), & \text{for } \text{N_l}/2 \le n < \text{N_l} \end{cases}$$

After windowing, the time domain values ($z_{i,n}$) can be expressed as:

$$z_{i,n} = w(n) \cdot X_{i,n};$$

b) LONG_START_SEQUENCE:

The LONG_START_SEQUENCE can be used to obtain a correct overlap and add for a block transition from an ONLY_LONG_SEQUENCE to any block with a low-overlap (short window slope) window half on the left (EIGHT_SHORT_SEQUENCE, LONG_STOP_SEQUENCE, STOP_START_SEQUENCE or LPD_SEQUENCE).

Window length N_l and N_s is set to 2048 (1920) and 256 (240) respectively.

In case the following window sequence is not an LPD_SEQUENCE:

If window_shape==1 the window for LONG_START_SEQUENCE is given as follows:

$$W(n) = \begin{cases} W_{LEFT,N_l}(n), & \text{for } 0 \le n < \text{N_l}/2 \\ 1.0, & \text{for } \text{N_l}/2 \le n < \frac{3\text{N_l} - \text{N_s}}{4} \\ W_{KBD_RIGHT,N_s}\left(n + \frac{\text{N_s}}{2} - \frac{3\text{N_l} - \text{N_s}}{4}\right), & \text{for } \frac{3\text{N_l} - \text{N_s}}{4} \le n < \frac{3\text{N_l} + \text{N_s}}{4} \\ 0.0, & \text{for } \frac{3\text{N_l} + \text{N_s}}{4} \le n < \text{N_l} \end{cases}$$

If window_shape==0 the window for LONG_START_SEQUENCE looks like:

$$W(n) = \begin{cases} W_{LEFT,N_l}(n), & \text{for } 0 \le n < \text{N_l}/2 \\ 1.0, & \text{for } \text{N_l}/2 \le n < \frac{3\text{N_l} - \text{N_s}}{4} \\ W_{SIN_RIGHT,N_s}\left(n + \frac{\text{N_s}}{2} - \frac{3\text{N_l} - \text{N_s}}{4}\right), & \text{for } \frac{3\text{N_l} - \text{N_s}}{4} \le n < \frac{3\text{N_l} + \text{N_s}}{4} \\ 0.0, & \text{for } \frac{3\text{N_l} + \text{N_s}}{4} \le n < \text{N_l} \end{cases}$$

The windowed time-domain values can be calculated with the formula explained in a).

In case the following window sequence is an LPD_SEQUENCE:

If window_shape==1 the window for LONG_START_SEQUENCE is given as follows:

$$W(n) = \begin{cases} W_{LEFT,N_l}(n), & \text{for } 0 \le n < \frac{\text{N_l}}{2} \\ 1.0, & \text{for } \frac{\text{N_l}}{2} \le n < \frac{3\text{N_l} - \text{N_s}}{4} \\ W_{KBD_RIGHT,N_s/2}\left(n + \frac{\text{N_s}}{4} - \frac{3\text{N_l} - \text{N_s}}{4}\right), & \text{for } \frac{3\text{N_l} - \text{N_s}}{4} \le n < \frac{3\text{N_l}}{4} \\ 0.0, & \text{for } \frac{3\text{N_l}}{4} \le n < \text{N_l} \end{cases}$$

If window_shape==0 the window for LONG_START_SEQUENCE looks like:

$$W(n) = \begin{cases} W_{LEFT,N_l}(n), & \text{for } 0 \le n < \frac{\text{N_l}}{2} \\ 1.0, & \text{for } \frac{\text{N_l}}{2} \le n < \frac{3\text{N_l} - \text{N_s}}{4} \\ W_{SIN_RIGHT,N_s/2}\left(n + \frac{\text{N_s}}{4} - \frac{3\text{N_l} - \text{N_s}}{4}\right), & \text{for } \frac{3\text{N_l} - \text{N_s}}{4} \le n < \frac{3\text{N_l}}{4} \\ 0.0, & \text{for } \frac{3\text{N_l}}{4} \le n < \text{N_l} \end{cases}$$

c) EIGHT_SHORT

The window_sequence=EIGHT_SHORT comprises eight overlapped and added SHORT_WINDOWs with a length N_s of 256 (240) each. The total length of the window_sequence together with leading and following zeros is 2048 (1920). Each of the eight short blocks are windowed separately first. The short block number is indexed with the variable j=0, . . . , M−1 (M=N_l/N_s).

In case the following window sequence is an LPD_SEQUENCE:

The window_shape of the previous block influences the first of the eight short blocks ($W_0(n)$) only. If window_shape==1 the window functions can be given as follows:

$$W_0(n) = \begin{cases} W_{LEFT,N_s}(n), & \text{for } 0 \le n < \text{N_s}/2 \\ W_{KBD_RIGHT,N_s}(n), & \text{for } \text{N_s}/2 \le n < \text{N_s} \end{cases}$$

$$W_j(n) = \begin{cases} W_{KBD_LEFT,N_s}(n), & \text{for } 0 \le n < \text{N_s}/2 \\ W_{KBD_RIGHT,N_s}(n), & \text{for } \text{N_s}/2 \le n < \text{N_s} \end{cases},$$

$$0 < j < (M-1)$$

$$W_{M-1}(n) = \begin{cases} W_{KBD_LEFT,N_s}(n), & \text{for } 0 \le n < \text{N_s}/2 \\ W_{KBD_RIGHT,N_s}/2(n), & \text{for } \text{N_s}/2 \le n < 3\text{N_s}/4 \end{cases}$$

Otherwise, if window_shape==0, the window functions can be described as:

$$W_0(n) = \begin{cases} W_{LEFT,N_s}(n), & \text{for } 0 \le n < \text{N_s}/2 \\ W_{SIN_RIGHT,N_s}(n), & \text{for } \text{N_s}/2 \le n < \text{N_s} \end{cases}$$

$$W_j(n) = \begin{cases} W_{SIN_LEFT,N_s}(n), & \text{for } 0 \le n < \text{N_s}/2 \\ W_{SIN_RIGHT,N_s}(n), & \text{for } \text{N_s}/2 \le n < \text{N_s} \end{cases},$$

$$0 < j < (M-1)$$

$$W_{M-1}(n) = \begin{cases} W_{SIN_LEFT,N_s}(n), & \text{for } 0 \le n < \text{N_s}/2 \\ W_{SIN_RIGHT,N_s}/2(n), & \text{for } \text{N_s}/2 \le n < 3\text{N_s}/4 \end{cases}$$

The overlap and add between the EIGHT_SHORT window_sequence resulting in the windowed time domain values $z_{i,n}$ is described as follows:

$$Z_{i,n} = \begin{cases} 0, & \text{for } 0 \le n < \frac{\text{N_l} - \text{N_s}}{4} \\ x_{0,n-\frac{N_l-N_s}{4}} \cdot W_0\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ x_{j-1,n-\frac{N_l+(2j-3)N_s}{4}} \cdot W_{j-1}\left(n - \frac{\text{N_l} + (2j-3)\text{N_s}}{4}\right) + x_{j,n-\frac{N_l+(2j-1)N_s}{4}} \cdot W_j\left(n - \frac{\text{N_l} + (2j-1)\text{N_s}}{4}\right), & \text{for } 1 \le j < M, \ \frac{\text{N_l} + (2j-1)\text{N_s}}{4} \le n < \frac{\text{N_l} + (2j+1)\text{N_s}}{4} \\ x_{M-1,n-\frac{N_l+(2M-3)N_s}{4}} \cdot W_{M-1}\left(n - \frac{\text{N_l} + (2M-3)\text{N_s}}{4}\right), & \text{for } \frac{\text{N_l} + (2M-1)\text{N_s}}{4} \le n < \frac{\text{N_l} + (2M)\text{N_s}}{4} \\ 0, & \text{for } \frac{\text{N_l} + (2M)\text{N_s}}{4} \le n < \text{N_l} \end{cases}$$

In all other cases:

The window_shape of the previous block influences the first of the eight short blocks ($W_0(n)$) only. If window_shape==1 the window functions can be given as follows:

$$W_0(n) = \begin{cases} W_{LEFT,N_s}(n), & \text{for } 0 \le n < \text{N_s}/2 \\ W_{KBD_RIGHT,N_s}(n), & \text{for } \text{N_s}/2 \le n < \text{N_s} \end{cases}$$

$$W_j(n) = \begin{cases} W_{KBD_LEFT,N_s}(n), & \text{for } 0 \le n < \text{N_s}/2 \\ W_{KBD_RIGHT,N_s}(n), & \text{for } \text{N_s}/2 \le n < \text{N_s} \end{cases},$$

$$0 < j \le M-1$$

Otherwise, if window_shape==0, the window functions can be described as:

$$W_0(n) = \begin{cases} W_{LEFT,N_s}(n), & \text{for } 0 \le n < \text{N_s}/2 \\ W_{SIN_RIGHT,N_s}(n), & \text{for } \text{N_s}/2 \le n < \text{N_s} \end{cases}$$

$$W_j(n) = \begin{cases} W_{SIN_LEFT,N_s}(n), & \text{for } 0 \le n < \text{N_s}/2 \\ W_{SIN_RIGHT,N_s}(n), & \text{for } \text{N_s}/2 \le n < \text{N_s} \end{cases},$$

$$0 < j \le M-1$$

The overlap and add between the EIGHT_SHORT window_sequence resulting in the windowed time domain values $z_{i,n}$ is described as follows:

$$z_{i,n} = \begin{cases} 0, & \text{for } 0 \le n < \frac{\text{N_l} - \text{N_s}}{4} \\ x_{0,n-\frac{N_l-N_s}{4}} \cdot W_0\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ x_{j-1,n-\frac{N_l+(2j-3)N_s}{4}} \cdot W_{j-1}\left(n - \frac{\text{N_l} + (2j-3)\text{N_s}}{4}\right) + x_{j,n-\frac{N_l+(2j-1)N_s}{4}} \cdot W_j\left(n - \frac{\text{N_l} + (2j-1)\text{N_s}}{4}\right), & \text{for } 1 \le j < M, \ \frac{\text{N_l} + (2j-1)\text{N_s}}{4} \le n < \frac{\text{N_l} + (2j+1)\text{N_s}}{4} \\ x_{M-1,n-\frac{N_l+(2M-3)N_s}{4}} \cdot W_{M-1}\left(n - \frac{\text{N_l} + (2M-3)\text{N_s}}{4}\right), & \text{for } \frac{\text{N_l} + (2M-1)\text{N_s}}{4} \le n < \frac{\text{N_l} + (2M+1)\text{N_s}}{4} \\ 0, & \text{for } \frac{\text{N_l} + (2M+1)\text{N_s}}{4} \le n < \text{N_l} \end{cases}$$

d) LONG_STOP_SEQUENCE

This window_sequence is needed to switch from an EIGHT_SHORT_SEQUENCE back to an ONLY_LONG_SEQUENCE.

If window_shape==1 the window for LONG_STOP_SEQUENCE is given as follows:

$$W(n) = \begin{cases} 0.0, & \text{for } 0 \le n < \frac{\text{N_l} - \text{N_s}}{4} \\ W_{LEFT,N_s}\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ 1.0, & \text{for } \frac{\text{N_l} + \text{N_s}}{4} \le n < \text{N_l}/2 \\ W_{KBD_RIGHT,N_l}(n), & \text{for } \text{N_l}/2 \le n < \text{N_l} \end{cases}$$

If window_shape==0 the window for LONG_START_SEQUENCE is determined by:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<N_l/2\\ W_{SIN_RIGHT,N_l}(n), & \text{for } N_l/2\le n<N_l\end{cases}$$

The windowed time domain values can be calculated with the formula explained in a).

e) STOP_START_SEQUENCE:

The STOP_START_SEQUENCE can be used to obtain a correct overlap and add for a block transition from any block with a low-overlap (short window slope) window half on the right to any block with a low-overlap (short window slope) window half on the left and if a single long transform is desired for the current frame.

Window length N_l and N_s is set to 2048 (1920) and 256 (240) respectively.

In case the following window sequence is not an LPD_SEQUENCE:

If window_shape==1 the window for STOP_START_SEQUENCE is given as follows:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<\frac{3N_l-N_s}{4}\\ W_{KBD_RIGHT,N_s}\left(n+\frac{N_s}{2}-\frac{3N_l-N_s}{4}\right), & \text{for } \frac{3N_l-N_s}{4}\le n<\frac{3N_l+N_s}{4}\\ 0.0, & \text{for } \frac{3N_l+N_s}{4}\le n<N_l\end{cases}$$

If window_shape==0 the window for STOP_START_SEQUENCE looks like:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<\frac{3N_l-N_s}{4}\\ W_{SIN_RIGHT,N_s}\left(n+\frac{N_s}{2}-\frac{3N_l-N_s}{4}\right), & \text{for } \frac{3N_l-N_s}{4}\le n<\frac{3N_l+N_s}{4}\\ 0.0, & \text{for } \frac{3N_l+N_s}{4}\le n<N_l\end{cases}$$

In case the following window sequence is an LPD_SEQUENCE:

If window_shape==1 the window for STOP_START_SEQUENCE is given as follows:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<\frac{3N_l-N_s}{4}\\ W_{KBD_RIGHT,N_s/2}\left(n+\frac{N_s}{2}-\frac{3N_l-N_s}{4}\right), & \text{for } \frac{3N_l-N_s}{4}\le n<\frac{3N_l}{4}\\ 0.0, & \text{for } \frac{3N_l}{4}\le n<N_l\end{cases}$$

If window_shape==0 the window for STOP_START_SEQUENCE looks like:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<\frac{3N_l-N_s}{4}\\ W_{SIN_RIGHT,N_s/2}\left(n+\frac{N_s}{2}-\frac{3N_l-N_s}{4}\right), & \text{for } \frac{3N_l-N_s}{4}\le n<\frac{3N_l}{4}\\ 0.0, & \text{for } \frac{3N_l}{4}\le n<N_l\end{cases}$$

The windowed time-domain values can be calculated with the formula explained in a).

f) STOP_1152_SEQUENCE:

The STOP_1152 SEQUENCE is needed to obtain a correct overlap and add for a block transition from a LPD_SEQUENCE to ONLY_LONG_SEQUENCE.

Window length N_l and N_s is set to 2048 (1920) and 256 (240) respectively. If window_shape==1 the window for STOP_1152_SEQUENCE is given as follows:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{2N_l+3N_s}{4}\\ W_{KBD_RIGHT,N_l}\left(n+\frac{N_l}{2}-\frac{2N_l+3N_s}{4}\right), & \text{for } \frac{2N_l+3N_s}{4}\le n<N_l+\frac{3N_s}{4}\\ 0.0, & \text{for } N_l+\frac{3N_s}{4}\le n<N_l+N_s\end{cases}$$

If window_shape==0 the window for STOP__1152_SEQUENCE looks like:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{2N_l+3N_s}{4}\\ W_{SIN_RIGHT,N_l}\left(n+\frac{N_l}{2}-\frac{2N_l+3N_s}{4}\right), & \text{for } \frac{2N_l+3N_s}{4}\le n<N_l+\frac{3N_s}{4}\\ 0.0, & \text{for } N_l+\frac{3N_s}{4}\le n<N_l+N_s\end{cases}$$

The windowed time-domain values can be calculated with the formula explained in a).

g) STOP_START__1152_SEQUENCE:

The STOP_START__1152_SEQUENCE can be used to obtain a correct overlap and add for a block transition from a LPD_SEQUENCE to any block with a low-overlap (short window slope) window half on the left.

Window length N_l and N_s is set to 2048 (1920) and 256 (240) respectively.

In case the following window sequence is not an LPD_SEQUENCE:

If window_shape==1 the window for STOP_START__1152_SEQUENCE is given as follows:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{3N_l}{4}+\frac{N_s}{2}\\ W_{KBD_RIGHT,N_s}\left(n+\frac{N_s}{2}-\frac{3N_l}{4}+\frac{N_s}{2}\right), & \text{for } \frac{3N_l}{4}+\frac{N_s}{2}\le n<\frac{3N_l}{4}+N_s\\ 0.0, & \text{for } \frac{3N_l}{4}+N_s\le n<N_l+N_s\end{cases}$$

If window_shape==0 the window for STOP_START__1152_SEQUENCE looks like:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{3N_l}{4}+\frac{N_s}{2}\\ W_{SIN_RIGHT,N_s}\left(n+\frac{N_s}{2}-\frac{3N_l}{4}+\frac{N_s}{2}\right), & \text{for } \frac{3N_l}{4}+\frac{N_s}{2}\le n<\frac{3N_l}{4}+N_s\\ 0.0, & \text{for } \frac{3N_l}{4}+N_s\le n<N_l+N_s\end{cases}$$

In case the following window sequence is an LPD_SEQUENCE:

If window_shape==1 the window for STOP_START__1152_SEQUENCE is given as follows:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{3N_l}{4}+\frac{N_s}{2}\\ W_{KBD_RIGHT,N_s/2}\left(n+\frac{N_s}{2}-\frac{3N_l}{4}+\frac{N_s}{2}\right), & \text{for } \frac{3N_l}{4}+\frac{N_s}{2}\le n<\frac{3N_l}{4}+\frac{3N_s}{4}\\ 0.0, & \text{for } \frac{3N_l}{4}+\frac{3N_s}{4}\le n<N_l+N_s\end{cases}$$

If window_shape==0 the window for STOP_START__1152_SEQUENCE looks like:

$$W(n) = \begin{cases} 0.0, & \text{for } 0 \le n < \frac{N_l}{4} \\ W_{LEFT,N_s}\left(n - \frac{N_l}{4}\right), & \text{for } \frac{N_l}{4} \le n < \frac{N_l + 2N_s}{4} \\ 1.0, & \text{for } \frac{N_l + 2N_s}{4} \le n < \frac{3N_l}{4} + \frac{N_s}{2} \\ W_{SIN_RIGHT,N_s/2}\left(n + \frac{N_s}{2} - \frac{3N_l}{4} + \frac{N_s}{2}\right), & \text{for } \frac{3N_l}{4} + \frac{N_s}{2} \le n < \frac{3N_l}{4} + \frac{3N_s}{4} \\ 0.0, & \text{for } \frac{3N_l}{4} + \frac{3N_s}{4} \le n < N_l + N_s \end{cases}$$

The windowed time-domain values can be calculated with the formula explained in a).

4.3.3. Overlapping and Adding with Previous Window Sequence

Besides the overlap and add within the EIGHT_SHORT window_sequence the first (left) part (or "portion") of every window_sequence is overlapped and added with the second (right) part (or "portion") of the previous window_sequence resulting in the final time domain values $out_{i,n}$. The mathematic expression for this operation can be described as follows.

In case of ONLY_LONG_SEQUENCE, LONG_START_SEQUENCE, EIGHT_SHORT_SEQUENCE, LONG_STOP_SEQUENCE, and STOP_START_SEQUENCE:

$$out_{i,n} = z_{i,n} + z_{i-1,n+\frac{N}{2}};$$

$$\text{for } 0 \le n < \frac{N}{2},$$

$$N = 2048\ (1920)$$

In case of STOP_1152_SEQUENCE, STOP_START_1152_SEQUENCE:

$$out_{i,n} = z_{i,n} + z_{i-1,n+\frac{N_l}{2}+\frac{3N_s}{4}};$$

$$\text{for } 0 \le n < \frac{N_l}{2},$$

$$N_l = 2048,$$

$$N_s = 256$$

In case of going from the FD mode to LPD mode, depending on the window_sequence of the last FD mode block, a SIN (if window_sequence is 0) or KBD (if window_sequence is 1) window is applied on the left part of the first LPD_SEQUENCE to have a correct overlap and add with the previous frame.

$$W_{SIN_LEFT,N}(n) = \sin\left(\frac{\pi}{N}\left(n + \frac{1}{2}\right)\right) \quad \text{for } 0 \le n < \frac{N}{2} \text{ With } N = 128$$

$$W_{KBD_LEFT,N}(n) = \sqrt{\frac{\sum_{p=0}^{n} [W'(p, \alpha)]}{\sum_{p=0}^{N/2} [W'(p, \alpha)]}} \quad \text{for } 0 \le n < \frac{N}{2} \text{ With } N = 128$$

Figure 9:
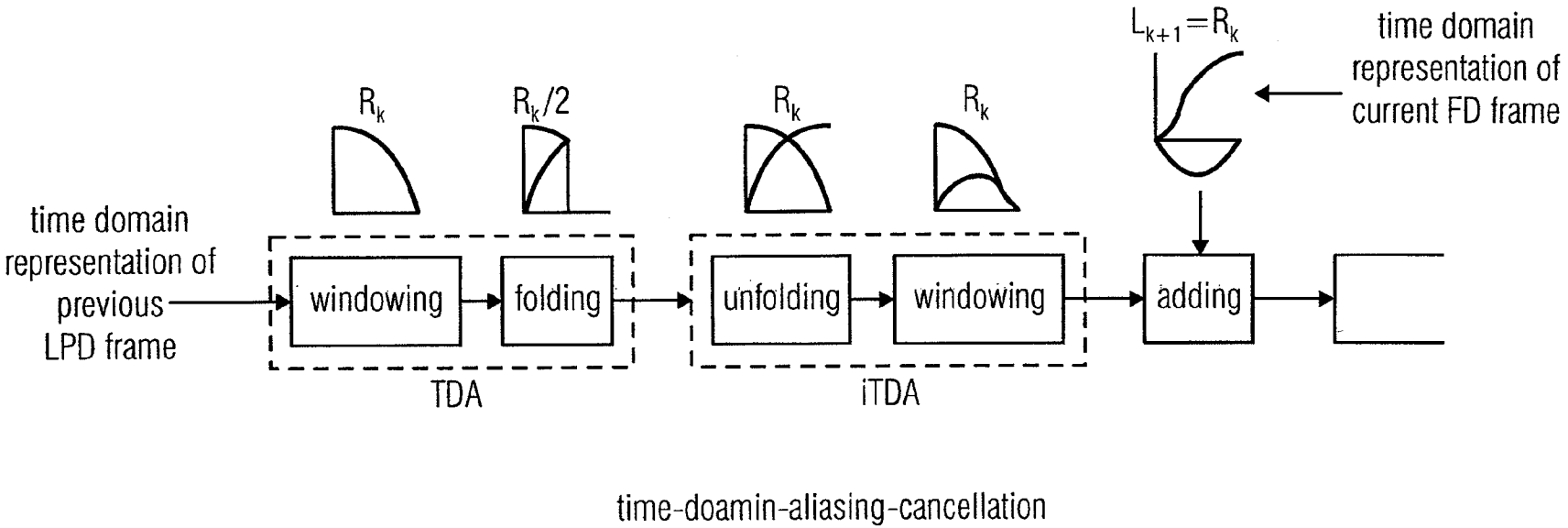
FIG. 9 shows a schematic representation of an overlap-and-add process between a time-domain representation of a previous linear-prediction-domain-encoded audio frame and a current frequency-domain encoded audio-frame.

In case of STOP_1152_SEQUENCE, STOP_START_1152_SEQUENCE the previous sequence is a LPD_SEQUENCE. In this case time domain aliasing components need to be artificially added to the decoded time domain signal in order to cancel the corresponding TDA components of the following FD mode frame. To facilitate this, the right end of the previous LPD_SEQUENCE needs to be windowed with a SIN window (as indicated by window_shape_previous_block), folded, unfolded and windowed again in an MDCT/IMDCT manner prior to the overlap add operation with the following frame according to FIG. 9.

5. Method for Providing an Encoded Audio Representation

In the following, a method for providing an encoded audio representation will be described taking reference to FIG. 7, which shows a flow chart of such a method.

Figure 7:
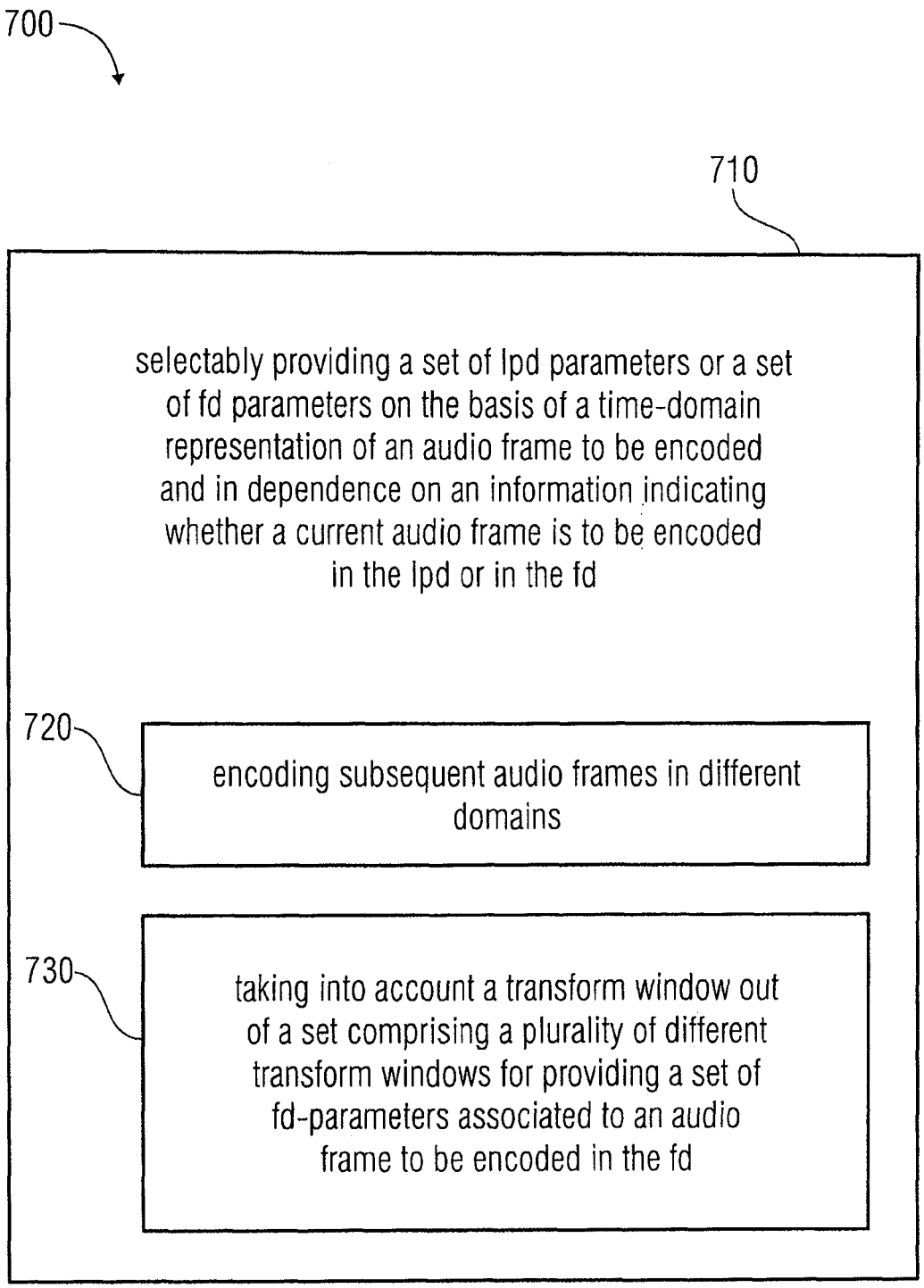
FIG. 7 shows a flowchart of a method for providing a decoded representation of an audio content.

The method 700 of FIG. 7 for providing an encoded representation of an audio content on the basis of an input audio representation of the audio content comprises selectively providing 710 a set of linear-prediction-domain parameters or a set of frequency-domain parameters on the basis of a time-domain representation of an audio frame to be encoded and in dependence on an information indicating whether a current audio frame is to be encoded in the linear-prediction-domain or in the frequency-domain. The method 700 comprises encoding 720 subsequent audio frames in different domains and taking into account 730 a transform window out of a set comprising a plurality of different transform windows for providing a set of frequency-domain parameters associated with an audio frame to be encoded in the frequency-domain.

In a first preferred embodiment of the method 700, an insertion window 384 is used for a generation of a set of frequency-domain parameters of a current audio frame to be encoded in the frequency-domain, if the current audio frame is embedded between a preceding audio frame to be encoded in the linear-prediction-domain and a subsequent audio frame to be encoded in the linear-prediction-domain. A left-sided transition slope of the insertion window is specifically adapted to provide for a smooth transition between a time-domain representation of the preceding audio frame encoded in the linear-prediction-domain and a time-domain representation of the current audio frame encoded in the frequency-domain. A right-sided transition slope of the insertion window is adapted to provide for a smooth transition between the frequency-domain representation of the current frame encoded in the frequency-domain and the time-domain representation of the subsequent audio frame encoded in the linear-prediction-domain. In other words, the transform window 384 is used in a first embodiment of the method 700. Accordingly, it is possible to obtain the sequence of audio frames and transform windows, which has been discussed with reference to FIG. 6*c*. Accordingly, the above-discussed advantages can be obtained.

In a second embodiment of the method 700, the set of transform windows comprises window types of different temporal resolutions adapted for a generation of a set of frequency-domain parameters of an audio frame to be encoded in the frequency-domain and comprising a transition towards a subsequent audio frame to be encoded in the linear-prediction-domain. For example, the transform windows 324 and 340 may both be available. Accordingly, the sequences of audio frames and transform windows shown in FIGS. 6*a* and 6*b* may both be obtainable, such that a bitrate-efficient encoding with good audio quality can be obtained in different situations, irrespective of whether there is a transient event in a frequency-domain-encoded audio frame preceding a linear-prediction-domain-encoded audio frame or not.

In a third embodiment of the method 700, the set of transform windows comprises a transition window 364 adapted for a generation of a set of frequency-domain parameters on the basis of a time-domain representation of a current audio frame, if the current audio frame follows a previous audio frame to be encoded in the frequency-domain using a high-temporal-resolution set of frequency-domain parameters and if the current audio frame comprises a transition towards a time-domain representation of a subsequent audio frame to be encoded in the linear-prediction-domain. In other words, the third embodiment of the method 700 uses the transform window 364 in order to obtain the sequence of audio frames and transform windows shown in FIG. 6*d*. Thus, an efficient encoding can be obtained even if there is a transient event during the last-but-one audio frame before a first linear-prediction-domain-encoded audio frame (speech-like audio frame).

6. Method for Providing a Decoded Audio Representation

Figure 8:
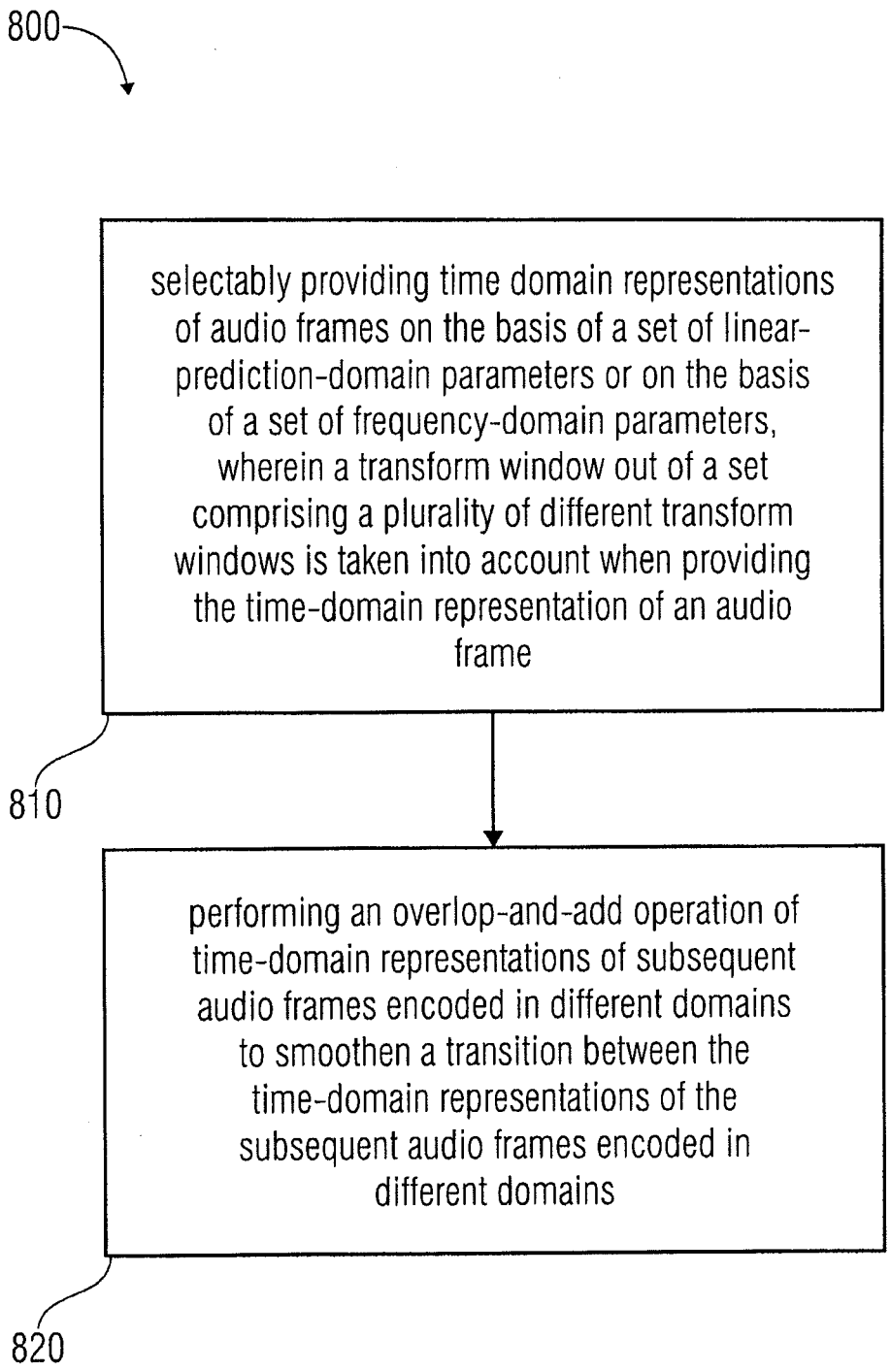
FIG. 8 shows a flowchart of a method for providing an encoded representation of an audio content.

In the following, a method for providing a decoded audio representation will be described taking reference to FIG. 8, which shows a flowchart of such method 800. The method 800 comprises selectively providing 810 time domain representations of audio frames on the basis of a set of linear-prediction-domain parameters or on the basis of a set of frequency-domain parameters, wherein a transform window out of a set comprising a plurality of different transform windows is taken into account when providing the time-domain representation of an audio frame. The method 800 also comprises performing 820 an overlap-and-add operation of the time-domain representations of subsequent audio frames encoded in different domains to smoothen a transition between the time-domain representations of the subsequent audio frames encoded in different domains.

In a first embodiment of the method 800, an insertion window 384 is selected as a transform window for the generation of a time-domain representation of a frequency-domain-encoded audio frame temporally embedded between a preceding frame encoded in the linear-prediction-domain and a subsequent audio frame encoded in the linear-prediction-domain. A left-sided transition slope of the insertion window is adapted to provide for a smooth transition between a time-domain representation of the preceding frame encoded in the linear-prediction-domain and the time-domain representation of the current audio frame encoded in the frequency-domain. A right-sided transition slope of the insertion window is adapted to provide for a smooth transition between the time-domain representation of the current audio frame encoded in the frequency-domain and a time-domain representation of the subsequent audio frame encoded in the linear-prediction-domain. Accordingly, the sequence of audio frames and transform windows shown in FIG. 6*c* can be decoded.

In a second embodiment of the method 800, window types of different temporal resolutions are used for the generation of time-domain representations of frequency-domain-encoded audio frames comprising a transition towards a time-domain representation of a linear-prediction-domain-encoded audio frame. Accordingly, sequences of audio frames as shown in FIGS. 6*a* and 6*b* are decoded according to the second embodiment of the method 800.

In a third embodiment of the method 800, a transition window adapted for the generation of a time-domain representation of a current frequency-domain encoded audio frame is used in order to provide a time-domain representation of a current frequency-domain encoded audio frame following a previous audio frame encoded in the frequency-domain using a high-temporal-resolution set of frequency domain parameters and comprising a transition towards a time-domain representation of a subsequent linear-prediction domain-encoded audio frame. Accordingly, a sequence of audio frames as shown in FIG. 6*d* is decoded.

It should be noted here that the methods 700, 800 can be supplemented by any of the features and functionalities discussed here with respect to the inventive apparatuses and the inventive transform windows.

7. Conclusion

Embodiments according to the present invention create an improvement of the transition from a frequency-domain encoding mode to a linear-prediction-domain encoding mode. In some simple embodiments, the transition from frequency-domain coding to linear-predictive-coding mode is performed by introducing the so-called "LPD_start_sequence" which acts as a transitional window for the frame immediately preceding the first frame of a "LPD_sequence". The "LPD_start_sequence" is effectively a "long_start_sequence" with a modified right window half.

However, technically, a "LPD_sequence" may also be preceded by a "stop_start_sequence", an "eight_short_sequence" or a "stop_start_1152_sequence". In these cases, the transform windows are adjusted, in accordance with the present invention, similar to the case of the "LPD_start_sequence".

Figure 10A:
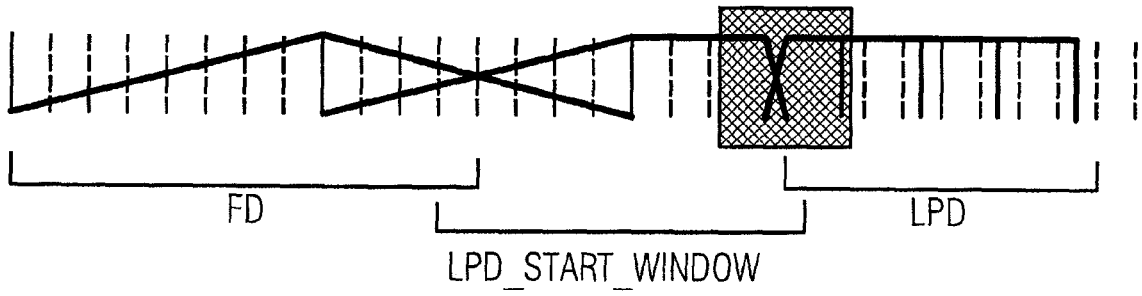
FIG. 10*a* shows a detailed schematic representation of a transition between an audio frame encoded using a window type "LPD_start_window" and an audio frame encoded in the linear-prediction-domain.

For example, a transition using the "LPD_start_sequence" is handled correctly, as it is shown in FIG. 10*a*.

However, it is important to note that the overlap-and-add should be implemented correctly in case of a transition from a "stop_start_1152_sequence" to a "LPD_sequence". The right window slope of the "stop_start_1152_sequence" should not be too long in order to avoid time-domain aliasing components which cannot be cancelled by the "LPD_sequence" contribution.

Figure 10B:
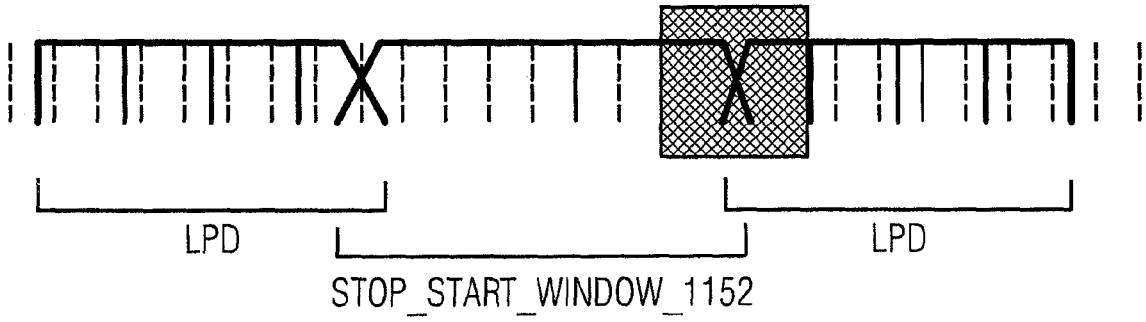
FIG. 10*b* shows a detailed schematic representation of a transition between an audio frame encoded using a window type "stop_start_window_1152" and a subsequent audio frame encoded in the linear-prediction-domain.

FIG. 10*b* shows a graphical representation of a correct transition between an audio frame encoded using window-type "stop_start_window_1152" and a subsequent audio frame encoded using the linear-prediction-domain.

In case of a short right window slope, the windowing after the inverse modified discrete cosine transform (IMDCT) and unfolding are not applied simultaneously for left and right window half. Rather, the right windowing is applied just before doing the overlap-add with the next frame.

When using a time-warped filterbank, the application of the frequency-domain (FD) to linear-prediction-domain (LPD) transition slope has to be done slightly differently, since the windowing of the right part has to be applied before resampling and therefore cannot be postponed. In this case, when a linear-prediction-domain frame follows a non-linear-prediction-domain frame, a ratio between a normal short slope and the frequency-domain-to-linear-prediction-domain transition slope is applied before overlap-add on the past frame data to achieve the same results.

It should be noted here that according to the present invention, the transition from frequency-domain mode to the linear-prediction-coding mode is described more generally than in other approaches, which makes the transition more consistent, more flexible and easier to comprehend.

8. Implementation Alternatives

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are preferably performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. An audio decoder for providing a decoded representation of an audio content on the basis of an encoded representation of the audio content, the audio decoder comprising:

a linear-prediction-domain decoder core configured to provide a time-domain representation of an audio frame on the basis of a set of linear-prediction domain parameters associated with the audio frame;

a frequency-domain decoder core configured to provide a time-domain representation of an audio frame on the basis of a set of frequency-domain parameters, taking into account a transform window out of a set comprising a plurality of different transform windows; and a signal combiner configured to overlap-and-add-time-domain representations of subsequent audio frames encoded in different domains, in order to smoothen a transition between the time-domain representations of the subsequent frames;

wherein the set of transform windows available for application by the frequency-domain decoder core comprises an insertion window adapted for a generation of a time-domain representation of a frequency-domain encoded audio frame temporally embedded between a preceding audio frame encoded in the linear-prediction domain and a subsequent audio frame encoded in the linear-prediction-domain, wherein a left-sided transition slope of the insertion window is adapted to provide for a smooth transition between a time-domain representation of the preceding frame encoded in the linear-prediction domain and a time-domain representation of the current frame encoded in the frequency-domain, and wherein a right-sided transition slope of the insertion window is adapted to provide for a smooth transition between the time-domain representation of the current frame encoded in the frequency-domain and a time-domain representation of the subsequent frame encoded in the linear-prediction domain.

2. The audio decoder according to claim 1, wherein a right-sided transition slope of the insertion window comprises a shorter temporal duration than right-sided transition slopes of additional transform windows adapted for a generation of a time-domain representation of a frequency-domain encoded audio frame comprising a transition towards a time-domain representation of a subsequent frequency-domain encoded audio frame.

3. The audio decoder according to claim 1, wherein the frequency-domain decoder core is configured to perform a lapped transform and to apply a transform window in order to provide the time-domain representation of a frequency-domain encoded audio frame; and wherein the right-sided transition slope of the insertion window is chosen such that the right-sided transition slope is entirely comprised in an aliasing-free portion of the corresponding frequency-domain encoded audio frame.

4. The audio decoder according to claim 1, wherein the right-sided transition slope of the insertion window is chosen such that the right-sided transition slope of the insertion window is restricted to an inner half of the right-sided extension of the audio frame, such that aliasing artifacts in an outer half of the right-sided extension of the audio frame are suppressed by the insertion window.

5. The audio decoder according to claim 1, wherein the left-sided transition slope of the insertion window is chosen such that the left-sided transition slope of the insertion window extends into an aliasing portion of the corresponding frequency-domain encoded audio frame.

6. The audio decoder according to claim 1, wherein the left-sided transition slope of the insertion window is chosen such that the left-sided transition slope of the insertion window extends into an outer half of a left-sided extension of the audio frame.

7. The audio decoder according to claim 1, wherein the left-sided transition slope of the transition window comprises a longer temporal extension than a right-sided transition slope of the transition window.

8. The audio decoder according to claim 1, wherein the signal combiner is configured to process an end portion of a time-domain signal representation of a previous audio frame encoded in the linear-prediction-domain, in order to introduce time-domain aliasing components into the end portion and to apply a transition window to the end portion; and wherein the signal combiner is further configured to perform an overlap-and-add operation to overlap-and-add the processed end portion of the time-domain representation of the previous audio frame, encoded in the linear-predicted-domain, with a start portion of a windowed time-domain representation of a current frequency-domain encoded audio frame, such that the processed end portion of the time-domain representation of the previous audio frame, into which the time-domain aliasing components have been introduced, is combined with a portion of the windowed time-domain representation of the current time-domain encoded audio frame to which portion the left-sided transition slope of the insertion window has been applied; wherein a length of the left-sided transition slope of the insertion window is identical to a length of a windowing applied to the end portion of the time-domain representation of the previous audio frame.

9. The audio decoder according to claim 1, wherein the signal combiner is configured to apply a window to a left-sided portion of a time-domain representation of a subsequent linear-prediction-domain encoded audio frame; and wherein the signal combiner is configured to perform an overlap-and-add operation to overlap-and-add an end portion a windowed time-domain representation of the current frequency-domain encoded audio frame and the windowed left-sided portion of the time-domain representation of the subsequent linear-prediction-domain encoded audio frame, wherein a length of the right-sided transition slope of the insertion window is identical to a length of a windowing applied to a left-sided portion of the time-domain representation of the subsequent linear-prediction-domain-encoded audio frame.

10. The audio decoder according to claim 1, wherein the signal combiner is configured to perform an overlap-and-add operation comprising a time-domain-aliasing cancellation at a transition from a time-domain representation of a previous linear-prediction-domain encoded audio frame to a time-domain representation of a current frequency-domain encoded audio frame; and wherein the signal combiner is configured to perform an overlap-and-add operation without a time-domain-aliasing cancellation at a transition from the time-domain representation of the current frequency-domain encoded audio frame to a time-domain-representation of a subsequent linear-prediction-domain encoded audio frame; and wherein a left-sided transition slope of the insertion window is adapted for the overlap-and-add operation with time-domain-aliasing cancellation of the time-domain representations of the previous linear-prediction-domain encoded audio frame and the current time-domain encoded audio frame, wherein the right-sided transition slope of the insertion window is adapted for an overlap-and-add operation without time-domain-aliasing cancellation of the time-domain representations of the current frequency-domain encoded audio frame and a subsequent linear-prediction-domain encoded audio frame.

11. An audio encoder for providing an encoded representation of an audio content on the basis of an input audio representation of the audio content, the audio encoder comprising:

a linear-prediction-domain encoder core configured to provide a set of linear-prediction-domain parameters on the basis of a time-domain representation of an audio frame to be encoded in the linear-prediction-domain;

a frequency-domain encoder core configured to provide a set of frequency-domain parameters on the basis of a time-domain representation of an audio frame to be encoded in the frequency-domain, taking into account a transform window out of a set comprising a plurality of different transform windows;

wherein the audio encoder is adapted to encode subsequent, overlapping or non-overlapping, audio frames in different domains;

wherein the set of transform windows available for application by the frequency-domain encoder comprises an insertion window adapted for a generation of a set of frequency-domain parameters of an audio frame to be encoded in the frequency-domain, which audio frame to be encoded in the frequency-domain is embedded between a preceding audio frame to be encoded in the linear-prediction-domain and a subsequent audio frame to be encoded in the linear-prediction-domain;

wherein a left-sided transition slope of the insertion window is adapted to provide for a smooth transition between a time-domain representation of the preceding frame to be encoded in the linear-prediction-domain and a time-domain representation of the current audio frame to be encoded in the frequency-domain; and wherein a right-sided transition slope of the insertion window is adapted to provide for a smooth transition between the time-domain representation of the current audio frame to be encoded in the frequency-domain and a time-domain representation of the subsequent audio frame to be encoded in the linear-prediction-domain.

12. A method for providing a decoded representation of an audio content on the basis of an encoded representation of the audio content, the method comprising:

selectably providing time-domain representations of audio frames on the basis of a set of linear-prediction-domain parameters associated with an audio frame or on the basis of a set of frequency-domain parameters associated with an audio frame, wherein a transform window out of a set comprising a plurality of different transform windows is taken into account when providing the time-domain representation of a frequency-domain encoded audio frame; and performing an overlap-and-add operation of time-domain representations of subsequent audio frames encoded in different domains to smoothen a transition between the time-domain representations of the subsequent audio frames encoded in different domains;

wherein an insertion window is selected as a transform window for the generation of a time-domain representation of a frequency-domain encoded audio frame temporally embedded between a preceding audio frame encoded in the linear-prediction-domain and a subsequent audio frame encoded in a linear-prediction-domain, wherein a left-sided transition slope of the insertion window is adapted to provide for a smooth transition between a time-domain representation of the preceding audio frame encoded in the linear-prediction-domain and a time-domain representation of the current audio frame encoded in the frequency-domain, and wherein a right-sided transition slope of the insertion window is adapted to provide for a smooth transition between the time-domain representation of the current audio frame encoded in the frequency-domain and a time-domain representation of the subsequent audio frame encoded in the linear-prediction-domain.

13. A method for providing an encoded representation of an audio content on the basis of an input audio representation of the audio content, the method comprising:

selectably providing a set of linear-prediction-domain parameters or a set of frequency-domain parameters on the basis of a time-domain representation of an audio frame to be encoded, in dependence on an information indicating whether a current audio frame is to be encoded in the linear-prediction-domain or in the frequency-domain, wherein subsequent audio frames are encoded in different domains;

wherein a transform window out of a set comprising a plurality of different transform windows is taken into account for providing a set of frequency-domain parameters associated to an audio frame to be encoded in the frequency-domain;

wherein an insertion window is used for a generation of a set of frequency-domain parameters of a current audio frame to be encoded in the frequency-domain, which current audio frame is embedded between a preceding audio frame to be encoded in the linear-prediction-domain and a subsequent audio frame to be encoded in the linear-prediction-domain, wherein a left-sided transition slope of the insertion window is adapted to provide for a smooth transition between a time-domain representation of the preceding audio frame to be encoded in the linear-prediction-domain and a time-domain representation of the current audio frame to be encoded in the frequency-domain, and wherein a right-sided transition slope of the insertion window is adapted to provide for a smooth transition between the time-domain representation of the current audio frame to be encoded in the frequency-domain and a time-domain representation of the subsequent audio frame to be encoded in the linear-prediction-domain.

14. An audio decoder for providing a decoded representation of an audio content on the basis of an encoded representation of the audio content, the audio decoder comprising:

a linear-prediction-domain decoder core configured to provide a time-domain representation of an audio frame on the basis of a set of linear-prediction-domain parameters of the audio frame;

a frequency-domain decoder core configured to provide a time-domain representation of an audio frame on the basis of a set of frequency-domain parameters of the audio frame, taking into account a transform window out of a set comprising a plurality of different transform windows; and a signal combiner configured to overlap-and-add time-domain representations of subsequent audio frames encoded in different domains, to smoothen a transition between the time-domain representations of the subsequent audio frames;

wherein the set of transform windows available for application by the frequency-domain decoder core comprises window types of different temporal resolutions adapted for a generation of a time-domain representation of a frequency-domain encoded audio frame comprising a transition towards a time-domain representation of a linear-prediction-domain encoded audio frame.

15. The audio decoder according to claim 14, wherein the right-sided transition slopes of the transform windows adapted for a generation of a time-domain representation of a frequency-domain encoded audio frame comprising a transition towards a time-domain representation of a linear-prediction-domain encoded audio frame comprise a shorter temporal duration than right-sided transition slopes of additional transform windows adapted for a generation of a time-domain representation of a frequency-domain encoded audio frame comprising a transition towards a time-domain representation of another frequency-domain encoded audio frame.

16. The audio decoder according to claim 15, wherein the frequency-domain decoder core is configured to perform a lapped transform and to apply a transform window in order to provide the time-domain representation of an audio frame; and wherein the right-sided transition slopes of the transform windows adapted for a generation of a time-domain representation of a frequency-domain encoded audio frame comprising a transition towards a time-domain representation of a linear-prediction-domain encoded audio frame, in the following designated as "frequency-domain to linear-prediction-domain transition transform windows", are chosen such that the right-sided transition slopes are comprised in an aliasing-free portion of the corresponding frequency-domain encoded audio frame.

17. The audio decoder according to claim 14, wherein the right-sided transition slopes of the frequency-domain to linear-prediction-domain transition transform windows are chosen such that the right-sided transition slopes of the frequency-domain to linear-prediction-domain transition transform windows are restricted to a left half of the right-sided extension of the current audio frame.

18. The audio decoder according to claim 14, wherein the set of transform windows available for application by the frequency-domain decoder core further comprises window types of different temporal resolution adapted for a generation of a time-domain representation of a frequency-domain encoded audio frame comprising a transition towards a time-domain representation of a frequency-domain encoded subsequent audio frame;

wherein the right-sided transition slopes of the transform windows adapted for generation of a time-domain representation of a frequency-domain encoded audio frame comprising a transition towards a time-domain representation of a frequency-domain encoded subsequent audio frame, in the following designated as "frequency-domain to frequency-domain transition transform windows" are chosen such that the right-sided transition slopes define an aliased transition portion adapted for an aliasing cancellation of aliasing artifacts comprised in a subsequent encoded audio frame.

19. The audio decoder according to claim 14, wherein the set of transform windows comprises a first window type comprising a comparatively lower temporal-resolution and a second window type comprising a comparatively higher temporal-resolution, wherein the second window type comprises a plurality of temporally overlapping subwindows associated with a single audio frame.

20. The audio decoder according to claim 19, wherein the second window type comprises a plurality of identical, temporally overlapping central subwindows and a shortened end subwindow, which is shorter in temporal duration than the central subwindows, wherein subsequent of the central subwindows comprise matched transition slopes of a first length, and wherein the shortened end subwindow comprises a left-sided transition slope of the first length and a right-sided transition slope of a second length, wherein the second length is shorter than the first length.

21. The audio decoder according to claim 20, wherein the second window type comprises an initial subwindow, wherein the initial subwindow is identical to the central subwindows, such that a left-sided transition slope of the initial subwindow is longer than a right-sided transition slope of the end subwindow.

22. The audio decoder according to claim 21, wherein the left-sided transition slope of the initial subwindow defines a time-domain-aliasing cancellation overlap between a time-domain representation of a previous audio frame encoded in the frequency-domain and a time-domain representation portion of the current audio frame associated to the initial subwindow, and wherein the right-sided transition slope of the end subwindow defines an aliasing-free overlap between a time-domain representation portion of the current audio frame associated to the end subwindow and a time-domain representation of a subsequent audio frame encoded in the linear-prediction-domain.

23. An audio encoder for providing an encoded representation of an audio content on the basis of an input audio representation of the audio content, the audio encoder comprising:

a linear-prediction-domain encoder core configured to provide a set of linear-prediction-domain parameters on the basis of a time-domain representation of an audio frame to be encoded in the linear-prediction-domain;

a frequency-domain encoder core configured to provide a set of frequency-domain parameters on the basis of a time-domain representation of an audio frame to be encoded in the frequency-domain, taking into account a transform window out of a set comprising a plurality of different transform windows;

wherein the audio encoder is adapted to encode subsequent, overlapping or non-overlapping, audio frames in different of the domains;

wherein the set of transform windows available for application by the frequency-domain encoder core comprises window types of different temporal resolutions adapted for a generation of a set of frequency-domain parameters of an audio frame to be encoded in the frequency-domain and comprising a transition towards a subsequent audio frame to be encoded in the linear-prediction-domain.

24. A method for providing a decoded representation of an audio content on the basis of an encoded representation of the audio content, the method comprising:

selectably providing time-domain representations of audio frames on the basis of a set of linear-prediction-domain parameters or on the basis of a set of frequency-domain parameters, wherein a transform window out of a set comprising a plurality of different transform windows is taken into account when providing the time-domain representation of an audio frame on the basis of a set of frequency-domain-parameters;

performing an overlap-and-add operation of time-domain representations of subsequent audio frames encoded in different domains to smoothen a transition between the time-domain representations of the subsequent audio frames encoded in different domains;

wherein window types of different temporal resolutions adapted for a generation of a time-domain representation of a frequency-domain encoded audio frame comprising a transition towards a time-domain representation of a linear-prediction-domain encoded audio frame are selected for a generation of time-domain representations of different audio frames encoded in the frequency-domain and being followed by respective subsequent audio frames encoded in the linear-prediction-domain.

25. A method for providing an encoded representation of an audio content on the basis of an input audio representation of the audio content, the method comprising:

selectably providing a set of linear-prediction-domain parameters or a set of frequency-domain parameters on the basis of a time-domain representation of an audio frame to be encoded, in dependence on an information indicating whether a current audio frame is to be encoded in the linear-prediction-domain or in the frequency-domain;

wherein subsequent audio frames are encoded in different domains;

wherein a transform window out of a set comprising a plurality of different transform windows is taken into account for providing a set of frequency-domain parameters associated to an audio frame to be encoded in the frequency-domain;

wherein window types of different temporal resolutions adapted for generation of a time-domain representation of a frequency-domain encoded audio frame comprising a transition towards a time-domain representation of a linear-prediction-domain encoded audio frame are used for a generation of sets of frequency-domain parameters of different audio frames to be encoded in the frequency-domain and followed by respective subsequent audio frames to be encoded in the linear-prediction-domain.

26. An audio decoder for providing a decoded representation of an audio content on the basis of an encoded representation of the audio content, the audio decoder comprising:

a linear-prediction-domain decoder core configured to provide a time-domain representation of a linear-prediction-domain encoded audio frame on the basis of a set of a linear-prediction-domain parameters;

a frequency-domain decoder core configured to provide a time-domain representation of a frequency-domain encoded audio frame on the basis of a set of frequency-domain parameters, taking into account a transform window out of a set comprising a plurality of different transform windows; and a signal combiner configured to overlap-and-add time-domain representations of subsequent audio frames in order to smoothen a transition between the time-domain representations of the subsequent audio frames;

wherein the frequency-domain encoder core is configured to selectively provide a time-domain representation of an audio frame on the basis of a high-temporal-resolution set of frequency-domain parameters representing the frequency-domain encoded audio frame at a comparatively high-temporal-resolution using a high-temporal-resolution transform window, or on the basis of a low-temporal-resolution set of frequency-domain parameters representing the frequency-domain encoded audio frame at a comparatively lower-temporal-resolution using a lower-temporal-resolution transform window;

wherein the set of transform windows available for application by the frequency-domain decoder core comprises a transition window adapted for generation of a time-domain representation of a current frequency-domain encoded audio frame, the current frequency-domain encoded audio frame following a previous audio frame encoded in the frequency-domain using a high-temporal-resolution set of frequency-domain parameters and the current frequency-domain-encoded audio frame comprising a transition towards a time-domain representation of a subsequent linear-prediction-domain encoded audio frame.

27. The audio decoder according to claim 26, wherein a left-sided transition slope of the transition window is adapted to a right-sided transition slope of the high-temporal-resolution window, such that the transition window comprises a temporally shorter transition slope than an additional transform window adapted for a generation of a time-domain representation of a given frequency-domain-encoded audio frame, the given frequency-domain-encoded audio frame following a previous audio frame encoded in the frequency-domain using a low-temporal-resolution set of frequency-domain parameters and the given frequency-domain-encoded audio frame comprising a transition towards a time-domain representation of a subsequent linear-prediction-domain-encoded audio frame.

28. The audio decoder according to claim 26, wherein a right-sided transition slope of the transition window comprises a shorter temporal duration than a right-sided transition slope of an additional transform window adapted for a generation of a time-domain representation of a frequency-domain-encoded audio frame comprising a transition towards a time-domain representation of another frequency-domain-encoded audio frame.

29. The audio decoder according to claim 26, wherein the frequency-domain decoder core is configured to perform a lapped transform and to apply a transform window in order to provide the time-domain representation of a current audio frame; and wherein the right-sided transition slope of the transition window is chosen such that the right-sided transition slope is entirely comprised in an aliasing-free portion of the corresponding frequency-domain-encoded audio frame.

30. The audio decoder according to claim 29, wherein the right-sided transition slope of the transition window is chosen such that the right-sided slope of the transition window is restricted to a left half of the right-sided extension of the corresponding frequency-domain-encoded audio frame.

31. The audio decoder according to claim 26, wherein the high-temporal-resolution window comprises a plurality of temporally overlapping subwindows associated with a single audio frame, and wherein a left-sided transition slope of the transition window is adapted to a right-sided transition slope of an end subwindow of the high-temporal-resolution window, such that aliasing components are cancelled by an overlap-and-add operation overlapping and adding a time-domain representation of an audio frame acquired using the high-temporal-resolution transform window and a time-domain representation of an audio frame acquired using the transition transform window.

32. An audio encoder for providing an encoded representation of an audio content on the basis of an input audio representation of the audio content, the audio encoder comprising:

a linear-prediction-domain encoder core configured to provide a set of linear-prediction-domain parameters on the basis of a time-domain representation of an audio frame to be encoded in the linear-prediction-domain;

a frequency-domain encoder core configured to provide a set of frequency-domain parameters on the basis of a time-domain representation of an audio frame to be encoded in the frequency-domain, taking into account a transform window out of a set comprising a plurality of different transform windows, wherein the frequency-domain encoder core is configured to selectively provide a high-temporal-resolution set of frequency-domain parameters representing the audio frame to be encoded in the frequency-domain at a comparatively higher temporal-resolution using a high-temporal-resolution window or a low-temporal-resolution set of frequency-domain parameters representing the audio frame to be encoded in the frequency-domain at a comparatively lower temporal-resolution using a low-temporal-resolution window;

wherein the audio encoder is adapted to encode subsequent, overlapping or non-overlapping, audio frames in different of the domains;

wherein the set of transform windows available for application by the frequency-domain encoder core comprises a transition window adapted for a generation of a set of frequency-domain parameters on the basis of a time-domain representation of a current audio frame, the current audio frame following a previous audio frame encoded in the frequency-domain using a high-temporal-resolution set of frequency-domain parameters and the current audio frame comprising a transition towards a time-domain representation of a subsequent audio frame to be encoded in the linear-prediction-domain.

33. A method for providing a decoded representation of an audio content on the basis of an encoded representation of the audio content, the method comprising:

selectably providing time-domain representations of audio frames on the basis of a set of linear-prediction-domain parameters or on the basis of a set of frequency-domain parameters, wherein a transform window out of a set comprising a plurality of different transform windows is taken into account when providing the time-domain representation of an audio frame on the basis of a set of frequency-domain parameters; and performing an overlap-and-add operation of time-domain representations of subsequent audio frames encoded in different domains to smoothen a transition between the time-domain representations of the subsequent audio frames encoded in different domains;

wherein time-domain representations of audio frames encoded in the frequency-domain are selectively provided on the basis of a high-temporal-resolution set of frequency-domain parameters representing a frequency-domain encoded audio frame at a comparatively higher-temporal-resolution using a high-temporal-resolution window, or on the basis of a low-temporal-resolution set of frequency-domain parameters representing the frequency-domain-encoded audio frame at a comparatively lower temporal resolution using a low-temporal-resolution window; and wherein a time-domain representation of a current frequency-domain-encoded audio frame following a previous audio frame encoded in the frequency-domain using a high-temporal-resolution set of frequency-domain parameters and followed by a subsequent audio frame encoded in the linear-prediction-domain is generated using a transition window which is adapted for a generation of a time-domain representation of the current frequency-domain encoded audio frame, the current frequency-domain encoded audio frame following the previous audio frame encoded in the frequency-domain using a high-temporal-resolution set of frequency-domain parameters and the current frequency-domain-encoded audio frame comprising a transition towards a time-domain representation of a subsequent linear-prediction-domain encoded audio frame.

34. A method for providing an encoded representation of an audio content on the basis of an input audio representation of the audio content, the method comprising:

selectably providing a set of linear-prediction-domain parameters or a set of frequency-domain parameters on the basis of a time-domain representation of an audio frame to be encoded, in dependence on an information indicating whether a current audio frame is to be encoded in the linear-prediction-domain or in the frequency-domain;

wherein subsequent audio frames are encoded in different domains;

wherein a transform window out of set comprising a plurality of different transform windows is taken into account for providing a set of frequency-domain parameters associated to an audio frame to be encoded in the frequency-domain;

wherein high-temporal resolution sets of frequency-domain parameters representing the audio frames to be encoded in the frequency-domain at a comparatively high temporal resolution are generated, using a high-temporal resolution window, for some of the audio frames to be encoded in the frequency-domain, and wherein low-temporal-resolution sets of frequency-domain parameters representing the audio frames to be encoded in the frequency-domain at a comparatively low temporal resolution are generated, using a low-temporal-resolution window, for other audio frames to be encoded in the frequency-domain; and wherein a transition window is used for a generation of a set of frequency-domain parameters on the basis of a time-domain representation of a current audio frame following a previous audio frame to be encoded in the frequency-domain using a high-temporal resolution set of frequency-domain parameters and followed by a subsequent audio frame to be encoded in the linear-prediction-domain, and wherein the transition window is adapted for a generation of a time-domain representation of a frequency-domain encoded audio frame following a previous audio frame encoded in the frequency-domain using a high-temporal-resolution set of frequency-domain parameters, and comprising a transition towards a time-domain representation of a subsequent linear-prediction-domain encoded audio frame.

35. A non-transitory computer-readable storage medium storing instructions, which when executed, cause one or more processors to perform the method according to one of the claim 12, 13, 24, 25, 33 or 34.

* * * * *